US006279900B1

(12) United States Patent
Yamagishi

(10) Patent No.: US 6,279,900 B1
(45) Date of Patent: Aug. 28, 2001

(54) SHEET GUIDE DEVICE WITH SHEET POSITION ADJUSTING MECHANISM AND IMAGE FORMING APPARATUS USING THE SAME DEVICE

(75) Inventor: Masaru Yamagishi, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/274,478

(22) Filed: Mar. 23, 1999

(30) Foreign Application Priority Data

| | | |
|---|---|---|
| Mar. 23, 1998 | (JP) | 10-094046 |
| Jul. 15, 1998 | (JP) | 10-199978 |
| Sep. 8, 1998 | (JP) | 10-253739 |
| Jan. 28, 1999 | (JP) | 1-019605 |

(51) Int. Cl.[7] ..... B65H 9/00; B65H 29/00
(52) U.S. Cl. ..... 271/240; 271/186
(58) Field of Search ..... 271/240, 186

(56) References Cited

U.S. PATENT DOCUMENTS

| | | | | |
|---|---|---|---|---|
| 3,574,755 | | 4/1971 | McConnell et al. . | |
| 4,657,239 | * | 4/1987 | Ikesue et al. | 271/240 |
| 4,984,779 | * | 1/1991 | Iwasaki | 271/186 |
| 5,091,754 | | 2/1992 | Abe et al. | 271/240 |
| 5,176,374 | | 1/1993 | Yamada | 271/9 |
| 5,195,734 | | 3/1993 | Tanabe | 271/9 |
| 5,219,154 | | 6/1993 | Fukube et al. | 271/18.2 |
| 5,316,282 | | 5/1994 | Fukube et al. | 271/10 |
| 5,737,682 | | 4/1998 | Yamagishi | 271/3.03 |
| 5,758,250 | | 5/1998 | Miki | 271/160 |

FOREIGN PATENT DOCUMENTS

| | | |
|---|---|---|
| 0 443 590 | 8/1991 | (EP) . |
| 2 336 358 | 10/1999 | (GB) . |
| 06051587 | 2/1994 | (JP) . |
| 7-033290 | 2/1995 | (JP) . |
| 07128921 | 5/1995 | (JP) . |
| 08081105 | 3/1996 | (JP) . |
| 09169459 | 6/1997 | (JP) . |
| 2692957 | 9/1997 | (JP) . |

* cited by examiner

*Primary Examiner*—John M. Jillions
(74) *Attorney, Agent, or Firm*—Oblon, Spivak, McClelland, Maier & Neustadt, P.C.

(57) ABSTRACT

A sheet guide device to guide a sheet being conveyed in a sheet conveying path of the device includes a device to adjust widthwise sheet positioning by regulating side edges of the sheet. The adjusting device is provided in a curved part of the sheet conveying path. The sheet guide device further includes a sheet conveying roller to convey the sheet. The adjusting device is positioned on a shaft of the sheet conveying roller and is slidable along the shaft. The sheet conveying roller reverses a conveying direction of the sheet. The adjusting device unitarily includes a guide member to guide the side edges of the sheet.

19 Claims, 19 Drawing Sheets

SHEET GUIDE DEVICE WITH SHEET POSITION ADJUSTING MECHANISM AND IMAGE FORMING APPARATUS USING THE SAME DEVICE

CROSS-REFERENCE TO RELATED APPLICATIONS

This document is based on Japanese Patent Application No. 10-094046 filed in the Japanese Patent Office on Mar. 23, 1998, on Japanese Patent Application No. 10-199978 filed in the Japanese Patent Office on Jul. 15, 1998, on Japanese Patent Application No. 10-253739 filed in the Japanese Patent Office on Sep. 8, 1998, and on Japanese Patent Application No. 11-019605 filed in the Japanese Patent Office on Jan. 28, 1999, the entire contents of which are hereby incorporated by reference.

BACKGROUND OF THE INVENTION

1. Field of the Invention

This invention relates to a sheet guide device of an image forming apparatus such as a copying machine, a facsimile, a printer, or the like, and more particularly to a sheet guide device which can guide a sheet with its widthwise position adjusted and convey the sheet without forming wrinkles in the sheet.

2. Discussion of the Related Art

Recently, with the widespread use of digital copying machines and printers, demands for improvement in the quality of image reproduction have been increasing and, for example, a precise positioning of an image on a sheet is particularly demanded. Additionally, with increasing environmental sensitivity among users, a duplex unit for two-sided copying has become important. In an image forming apparatus with a duplex unit, the sheet conveying path is longer than in an image forming apparatus for an ordinary one-sided copy, because a sheet carrying an image on one side of the sheet needs to be reversed for receiving another image on the other side of the sheet. Because of the long sheet conveying path, it is relatively difficult to prevent a sheet from being skewed. When a sheet is skewed, image quality on two sides of the sheet becomes uneven. In order to avoid sheet skew and the resulting lateral deviation of sheet positioning in the duplex unit, the duplex unit has been generally configured such that the sheet is temporarily stacked in an intermediate tray and is aligned by being jogged with side fence joggers.

FIGS. 1(A) and 1(B) illustrate a background duplex unit having a sheet positioning adjustment device. The duplex unit includes a reversible reverse roller 201, an intermediate tray 202, and a pair of side fences 203. The pair of side fences 203 moves in the direction indicated by B via a lengthwise extending groove 202*a* provided in the intermediate tray 202 such that the sheet is jogged with the side fences 203 to be aligned. When a sheet is fed into the duplex unit from a main body of an image forming apparatus (not shown), the sheet is reversed with the reverse roller 201 in the direction indicated by an arrow A in FIG. 1(A). Then, the sheet is stacked in the intermediate tray 202 between the pair of side fences 203 and the pressure applied by a pressing roller 204 is at once released as illustrated by a dotted line in FIG. 1(B). The pair of side fences 203 moves to jog a sheet in the direction indicated by an arrow B in FIG. 1(A) such that a distance between the opposed side fences 203 in the sheet width direction is equal to a predetermined sheet width and thereby, a deviation of the sheet positioning, e.g., sheet skew or resulting lateral deviation of sheet positioning, is corrected. A mechanism for driving the pair of side fences 203 is not shown. Thereafter, the reverse roller 201 is switched to be driven in a sheet refeed direction indicated by an arrow C in FIGS. 1(A) and 1(B) and the pressing roller 204 returns to a position to contact the reverse roller 201, so that the sheet is conveyed in the refeed direction by the reversing roller 201 and the pressing roller 204.

However, in the above-described duplex unit, if both sides of a sheet 205 are curled upwardly as indicated by an arrow D in FIG. 2(A), the linear dimension L' from one curled edge to another curled edge of the sheet 205 will be shorter than the sheet width L to which the side fences 203 are adjusted, i.e. L'<L, as illustrated in FIG. 2(B). Accordingly, in this condition, i.e. L'<L, the side fences 203 will not contact the edges of the sheet, even when the fences are driven to jog the sheet. As a result, the curled sheet 205 cannot be positioned adequately in the sheet width direction.

Japanese Laid-Open Patent Publication No.6-51587 of 1994 describes a sheet skew correcting device in a two-sided image forming apparatus in which a sheet stopper is placed ahead of feeding rollers in the sheet refeed direction, so that skew of a sheet is corrected when the sheet abuts the stopper. In this sheet skew correcting device, however, lateral deviation of sheet positioning is not corrected.

Additionally, Japan Patent Publication No. 2692957 of 1997 describes a background image forming apparatus configured to form an image on two sides of a sheet. In a switchback path of a switch back unit to reverse a sheet, a pair of reversible rollers is disposed for reversing a sheet. The switch back unit allows an entrance of a succeeding sheet into the switchback path when a trailing portion of a preceding sheet, which is switched to a reverse direction to be refed, is situated in the switchback path with the pair of reversible rollers being separated from each other. A lateral registration guide is disposed downstream of the reversible rollers for correcting lateral deviation of the sheet.

Japanese Laid-Open Patent Publication No. 8-81105 of 1996 describes a sheet reverse device in which a sheet is reversed by a pair of reversible rollers in a switchback path. The switchback path is Y-shaped and a separation pick, provided at the intersection of the separated paths of the Y-shaped path, switches between the separated paths to guide the sheet.

Japanese Laid-Open Patent Publication No.7-128921 of 1995 describes an optional duplex unit in which a sheet is conveyed to a reverse conveying path which is separated from a sheet conveying path in a main body. The sheet is then reversed by a pair of reversible rollers and adjusted for its sheet position by a sheet position adjusting device.

In Japanese Patent Publication No. 2692957, the switchback path and the lateral registration guide for adjusting sheet positioning are provided at separate positions. Therefore, a space for the switchback path and the lateral registration guide for adjusting sheet positioning is separately necessary, so that the image forming apparatus tends to be a bigger size. Further, because a sheet refeeding path inside the switchback unit is relatively long, a possibility of occurrence of a sheet skew and the resulting lateral deviation of the sheet may be increased. Therefore, a precise sheet positioning adjustment may be required.

In Japanese Laid-Open Patent Publication No. 8-81105, because the separation pick switches between the separated paths of the Y-shaped switch back path, a control operation of the separation pick is additionally required.

In Japanese Laid-Open Patent Publication No. 7-128921, the sheet is reversed and adjusted for its sheet position at separate positions like the sheet described in Japanese Patent Publication No. 2692957. Also, a space for carrying out sheet reversing and sheet positioning adjustment functions is separately necessary. Therefore, the duplex unit needs to be bigger and manufacturing costs may be increased.

SUMMARY OF THF INVENTION

In order to overcome the above-described problems with the background apparatuses, preferred embodiments of the present invention provide a sheet guide device and an image forming apparatus that can adjust a sheet position accurately in the widthwise direction and correct a sheet skew and any resulting lateral deviation of the sheet, even if a sheet is curled at its side edges.

The preferred embodiments of the present invention also provide a sheet guide device that is capable of adjusting the sheet position and reversing the sheet as well. By thus configuring the sheet guide device, a space saving can be achieved, and further, the device can be applied to various types of sheet conveying paths.

The preferred embodiments of the present invention further provide a sheet guide device and an image forming apparatus that can precisely adjust a sheet position widthwise in a curved sheet conveying path even if a sheet size is different due to a cutting error, and that can convey the sheet in a refeed direction without forming wrinkles in the sheet.

According to a preferred embodiment of the present invention, a sheet guide device to guide a sheet being conveyed in a sheet conveying path includes a device to adjust the widthwise sheet positioning by regulating side edges of the sheet. The adjusting device is provided in a curved part of the sheet conveying path.

The sheet guide device may further include a sheet conveying roller to convey the sheet. The adjusting device is positioned on a shaft of the sheet conveying roller and is slidable along the shaft.

The sheet conveying roller may reverse a conveying direction of the sheet. The adjusting device may unitarily include a guide member to guide the side edges of the sheet.

According to another embodiment of the present invention, a sheet guide device to guide a sheet being conveyed in a sheet conveying path includes a first guide member provided in the sheet conveying path to adjust the sheet positioning by regulating a side edge of the sheet. The first guide member is movable widthwise according to a sheet size. A first biasing device absorbs a difference in size of the sheet due to a cutting error of the sheet when the sheet position is adjusted. A second biasing device biases the side edge of the sheet in accordance with the difference in the size of the sheet when the sheet is conveyed. The first biasing device and the second biasing device are provided with the first guide member.

The sheet guide device may further include a second guide member being paired with the first guide member to adjust the sheet position by regulating the other side edge of the sheet. The second guide member is movable widthwise according to a sheet size. The sheet guide device further includes a third biasing device to bias the other side edge of the sheet in cooperation with the second biasing device when the sheet is conveyed. The third biasing device is provided to the second guide member.

A bias force by the first biasing device may be greater than contact resistance between the sheet and the sheet conveying path. The bias force by the first biasing device may be configured not to be applied to the sheet when the sheet is conveyed. The bias force of the second biasing device may be substantially the same as that of the third biasing device. The first and second guide members may be provided in a curved sheet reversing path.

According to still another embodiment of the present invention, a sheet guide device includes a sheet conveying path configured to convey and reverse a sheet. The sheet conveying path includes a curved sheet conveying part and a stack part configured to guide and temporarily stack the sheet downstream of the curved sheet conveying part. A first conveying guide directs the sheet to the curved sheet conveying part, and a first conveying device conveys the sheet to the curved sheet conveying part. A sheet position adjusting device is provided in the curved sheet conveying part and is configured to adjust the sheet position. A reverse conveying device is provided downstream of the first conveying device in the curved sheet conveying part to convey the sheet in the curved sheet conveying part in a reverse direction. A second conveying guide directs the sheet temporarily stacked in the stack path to be conveyed in the reverse direction.

The curved sheet conveying part may serve as a reverse path to reverse the sheet and the first conveying device may be provided at an intersection of the first conveying guide and the second conveying guide.

At least one guide conveying member to guide and convey the sheet may be provided on a shaft for the first conveying device so as to be positioned in a vicinity of a side edge of the sheet. A circumferential surface of the guide conveying member may be made uneven. The reverse conveying device may have a shape different from a round shape in a cross section. Further, a second conveying device may be provided downstream of the reverse conveying device in the second conveying guide to relay the sheet to be conveyed A distance between a fall point in which a trailing edge of the sheet falls after passing through the first conveying device and a nip portion of the second conveying device may be set smaller than a distance the sheet is conveyed by one rotation or two rotations of the reverse conveying device. The second conveying device may temporarily hold the sheet to place the sheet in a standby condition.

Other objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 6(A) being a schematic illustration of the sheet guide device,

FIG. 6(B) being a schematic side view of the sheet guide device, and

FIG. 6(C) being a sectional view for explaining a space between sheet side edges and jogger side fences;

DETAILED DESCRIPTION OF THF PREFERRED EMBODIMENTS

Figure 1A:
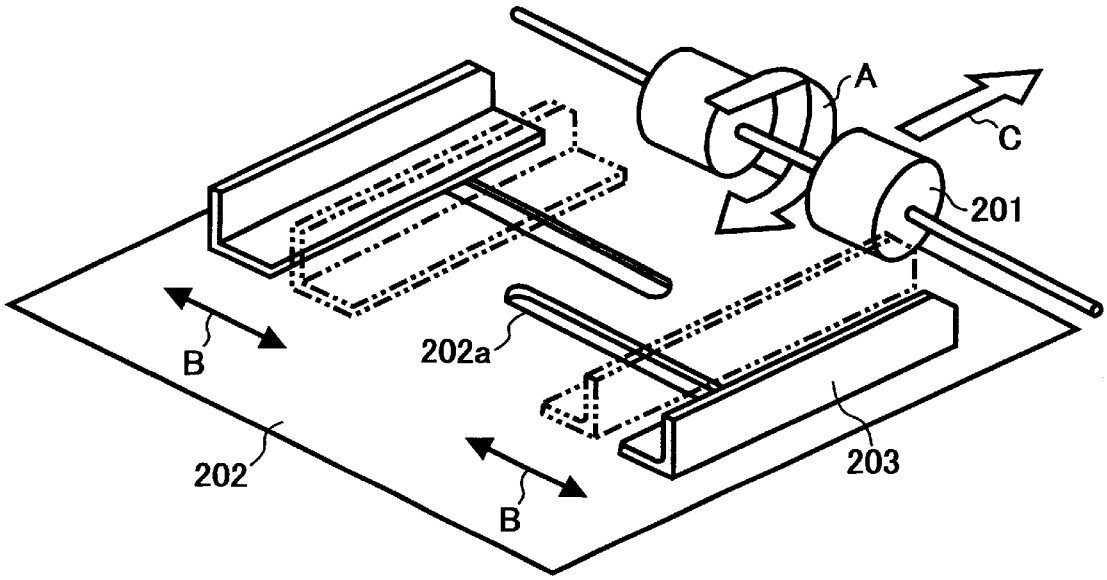
FIG. 1A BACKGROUND ART
FIGS. 1(A) and (B) are illustrations of a background duplex unit having a sheet position adjusting device, FIG. 1(A) being a perspective view of the duplex unit, and FIG. 1(B) being a side view of the duplex unit.

Referring now to the drawings, like reference numerals designate identical or corresponding parts throughout the several views. For the sake of clarity, the elements having the same functions as the ones described in the background example will be designated with the same reference numerals.

Figure 3A:
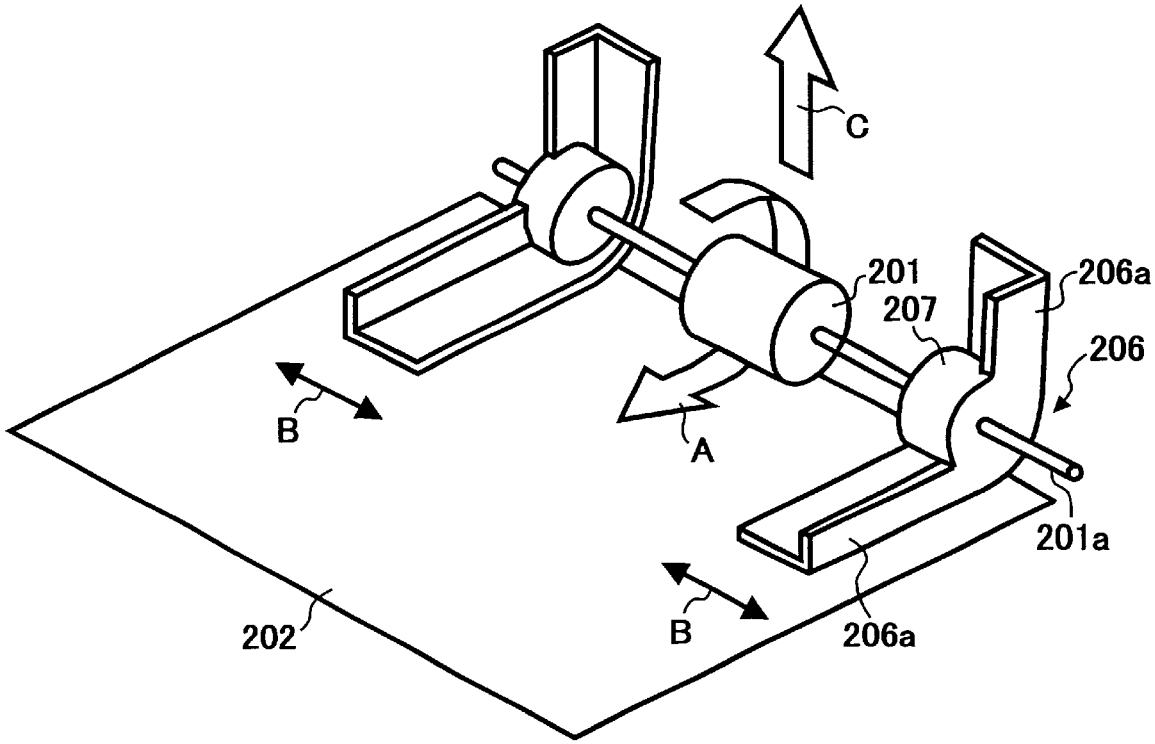
FIGS. 3(A) and (B) are illustrations of a sheet guide device of an image forming apparatus according to a first embodiment of the present invention, FIG. 3(A) being a perspective view of the sheet guide device, and FIG. 3(B) being a side view of the sheet guide device.
Figure 3B:
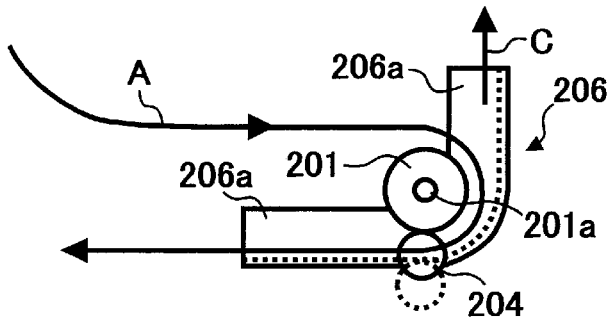

FIGS. 3(A) and 3(B) illustrate a sheet guide device having a sheet position adjusting mechanism for an image forming apparatus according to a first embodiment of the present invention.

In the first embodiment, a pair of adjusting members 206 is mounted on a shaft 201*a* for a reverse roller 201 such that the adjusting members 206 can slide smoothly along the shaft 201*a* in the jogging direction indicated by an arrow B in FIG. 3(A) to adjust the sheet position. A pair of guide portions 206*a* mounted on the adjusting members 206 is configured to move with the adjusting members 206 and precisely stop at a predetermined sheet position according to the size of a sheet being conveyed in order to guide the sheet. Further, reverse guide members 207 are mounted unitarily with the adjusting members 206. The reverse guide members 207 guide both comers of a leading edge of a sheet when the leading edge of the sheet is fed into the sheet guide device while the sheet is reversed by the reverse roller 201.

Figure 4:
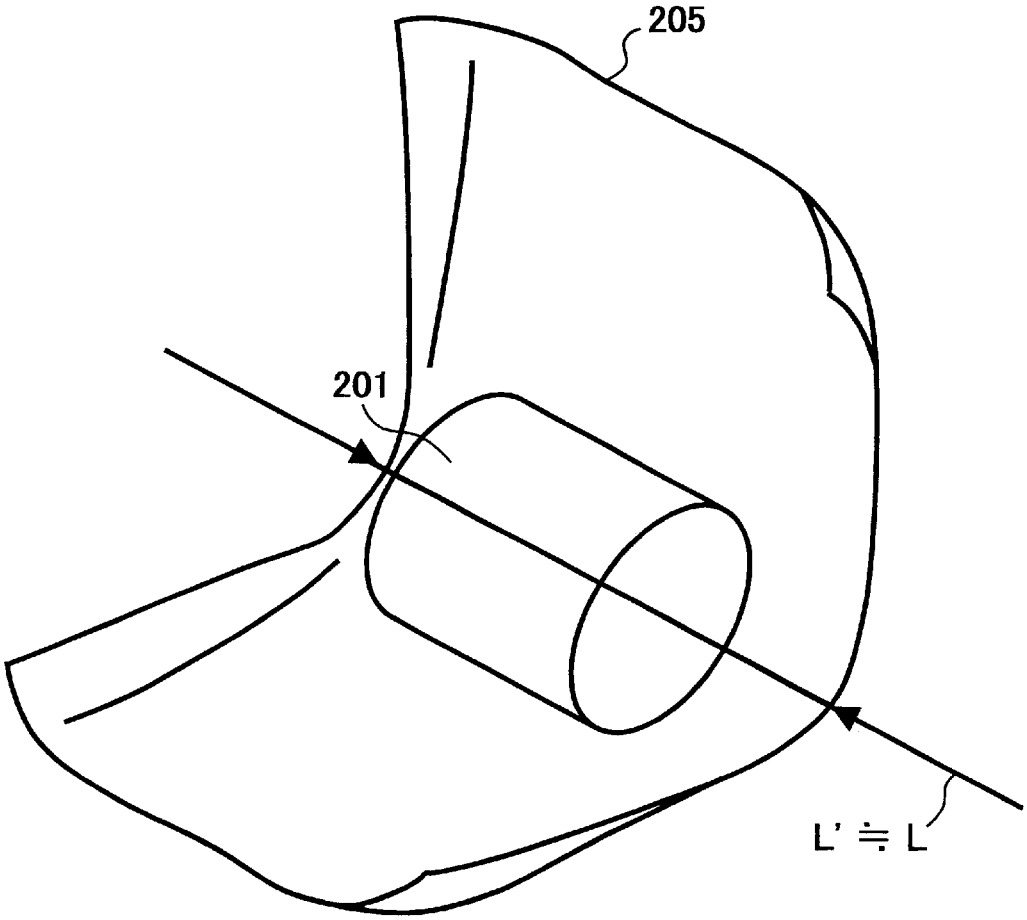
FIG. 4 is a perspective view of the sheet whose side curls are corrected in the sheet guide device in the first embodiment of the present invention.

Next, operations in the above-described sheet guide device are described. A sheet fed from an image forming apparatus (not shown) is reversed by the reverse roller 201 in the direction indicated by an arrow A, and is stacked in an intermediate tray 202. The sheet is reversed by the reverse roller 201 when pressure applied by a pressing roller 204 is not released, and is then fed out in the refeed direction indicated by an arrow C in FIGS. 3(A) and (B). As illustrated in FIG. 4, when a sheet 205 passes half way, through the reverse roller 201, the sheet 205 is stopped from advancing further by releasing the pressing roller 204 from the reverse roller 201, as illustrated by a dotted circle in FIG. 3(B). Then, the adjusting members 206 jog the sheet 205 to adjust its position. Thereafter, the pressing roller 204 abuts on the reverse roller 201 and the sheet 205 is conveyed again in the refeed direction indicated by an arrow C with both sides of the sheet 205 being guided by the guide portions 206*a* and the reverse guide members 207, as illustrated in FIG. 3(A).

In this configuration, even though the side edges of the sheet 205 are curled upwardly or downwardly relative to the intermediate tray 202, the reverse roller 201, the guide portions 206*a*, and the reverse guide members 207 correct the curls by bending the sheet 205 in the sheet conveying direction. More specifically, when the sheet 205 is bent in the sheet conveying direction half way through the reverse roller 201 as illustrated in FIG. 4, the linear dimension L' from one curled edge to another curled edge of the sheet 205 nearly equals the actual sheet width L because the curls of both side edges of the sheet 205 are corrected to be flat. Accordingly, when the adjusting members 206 jog the sheet 205, the sheet 205 can be accurately positioned by being sandwiched by the guide portions 206*a*, because the guide portions 206*a* are configured to stop precisely at the predetermined sheet position to guide the sheet. Moreover, the sheet 205 can be conveyed smoothly with the side edges securely guided while the sheet 205 is being reversed.

Figure 5:
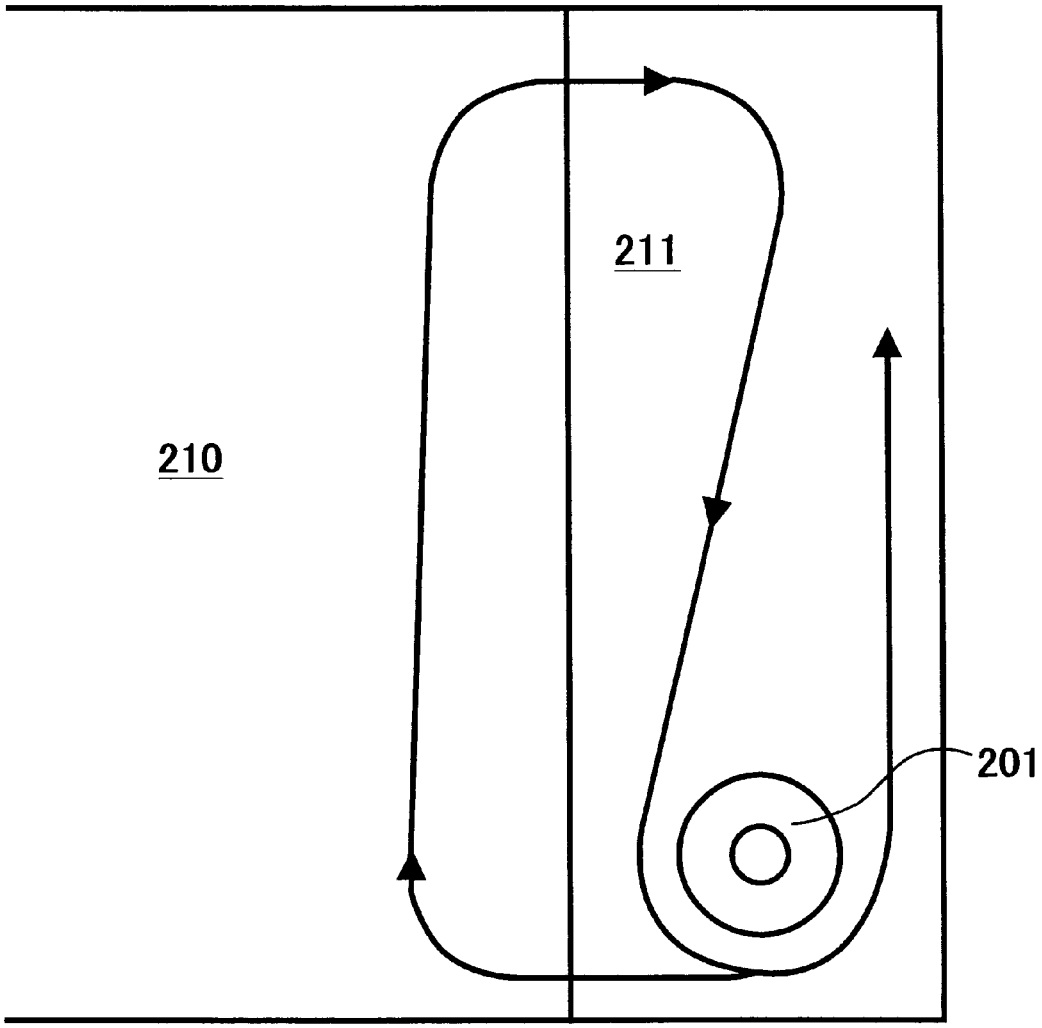
FIG. 5 is a sectional view of a sheet reversing unit having a vertical sheet conveying path to which the sheet guide device in the first embodiment of the present invention is also applied.

The above-described sheet guide device can be applied not only to the sheet conveying path illustrated in FIG. 3(B) but also to a vertical conveying path illustrated, for example, in FIG. 5. In FIG. 5, a main body of an image forming apparatus 210 and a sheet reversing unit 211 having a vertical conveying path are illustrated. Because the reversing and the position adjusting functions are combined in the sheet guide device, a space saving can be achieved. Further, the sheet guide device in the first embodiment may be applied not only to various sheet reversing paths as described above, but also to any sheet conveying paths in the image forming apparatus 210.

Figure 6A:
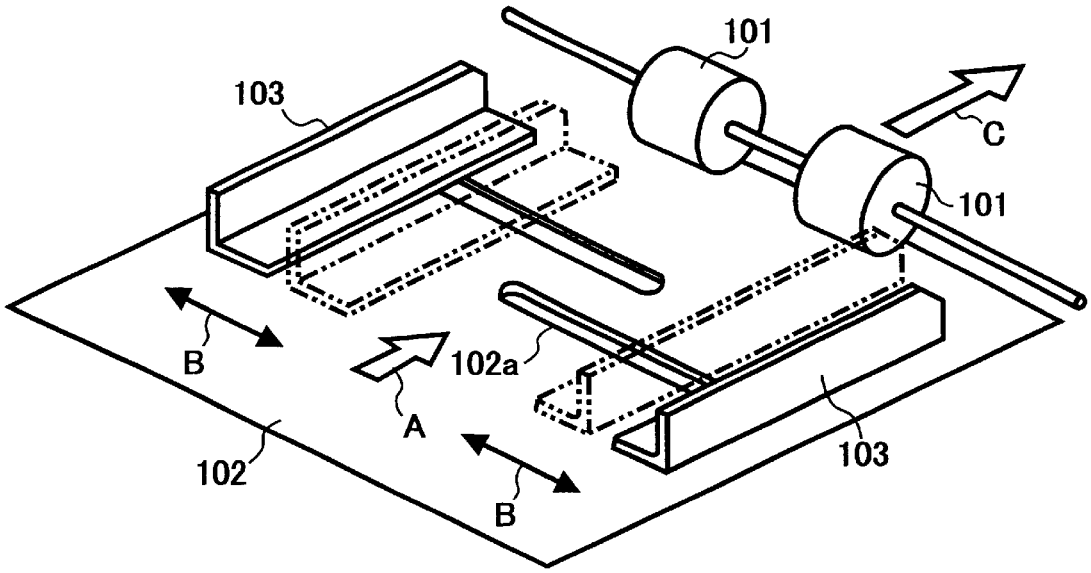
FIG. 6A BACKGROUND ART
FIGS. 6(A)–6(C) are illustrations of a background sheet guide device.

Next, a second embodiment of a sheet guide device having a sheet position adjusting mechanism will be described. Before explaining the second embodiment, a background sheet guide device having side fence joggers will be explained referring to FIGS. 6(A), (B), and (C). As illustrated in FIG. 6(A), the sheet guide device includes a conveying roller 101, a base plate 102, and a pair of side fences 103 which move in the direction indicated by an arrow B via grooves 102*a* which are provided in the base plate 102.

Figure 6B:
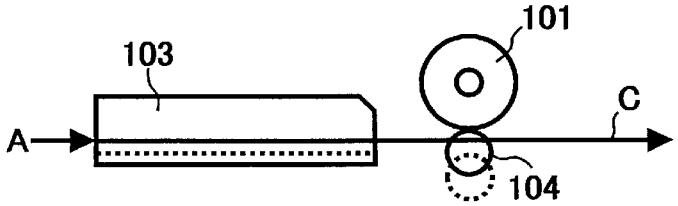
FIG. 6B BACKGROUND ART

In the above-described sheet guide device, a sheet fed from the direction indicated by an arrow A in FIG. 6(A) temporarily stops advancing when its leading edge passes through the conveying roller 101. The sheet is stopped by separating a pressing roller 104 from the conveying roller 101 as indicated by a dotted line in FIG. 6(B). Thereafter, the side fences 103 are driven by a drive mechanism (not shown) to jog the sheet in the direction indicated by an arrow B in FIG. 6(A) to adjust the sheet position in accordance with a predetermined sheet width. Then, the pressing roller 104 presses the sheet again to convey the sheet in the direction indicated by an arrow C in FIGS. 6(A) and 6(B).

Figure 6C:
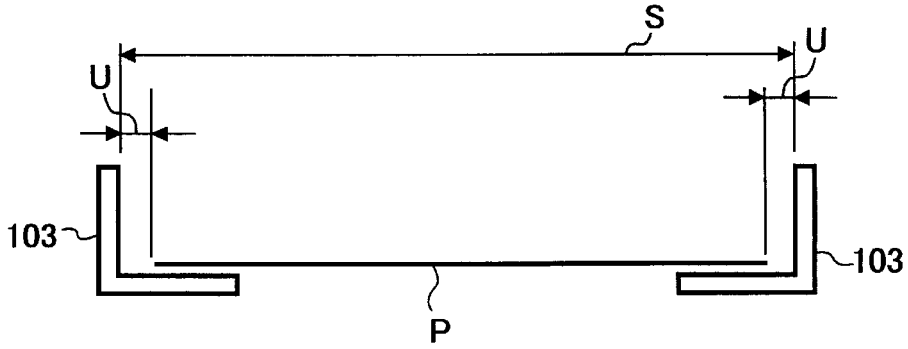
FIG. 6C BACKGROUND ART

In the above-described configuration, the difference of sheet size due to a cutting error, which is specified as to range "±2 mm of the standard size" for all sheet sizes including B5, A4, A3, etc, in Japanese Industrial Standards, is considered, and a space U is provided as illustrated in FIG. 6(C) between the side edge of the sheet and the side fence 103 such that the space U becomes relatively large when a sheet P having "the standard size—2 mm" is conveyed. As a result, when the sheet P has its smallest size, the sheet P shifts in the space U when the sheet P is conveyed by being pressed by the pressing roller 104 and precise sheet position adjustments cannot be achieved. In FIG. 6(C), a reference character S designates a span between the opposed side edges of the side fence pair 103 specifically set for each sheet size.

FIGS. 7(A) through 7(D) illustrate another background sheet guide device addressing the above-mentioned problem of shifting the sheet. In this case, the shifting is caused by a difference in sheet size. The sheet guide device includes a side fence 106, a side fence 107 disposed opposite the side fence 106 at a predetermined distance, and a belt 112 for driving the side fences 106 and 107. The side fence 106 is set as a standard position side and is configured to move to a predetermined standard position and stay in the standard position while a position of a sheet is being adjusted with reference to the standard position and also while the sheet is being conveyed in the refeed direction. The standard position corresponds to an image writing start position on the photoconductor drum.

Integrally provided with the side fence 107 is a frame 113 which includes a slider 109 and a biasing device 108 therein. The slider 109 serves as a coupling device which moves relative to the side fence 107 by being coupled with the belt 112 via a coupling portion 109*a*. The biasing device 108 which may be a spring, is supported and sandwiched between the side fence 107 and the slider 109. The side fence 106 is directly coupled with the belt 112 via a coupling portion 106*a*. The belt 112 is driven by a motor (not shown) via a driven pulley 110 and a drive pulley 111.

Figure 7A:
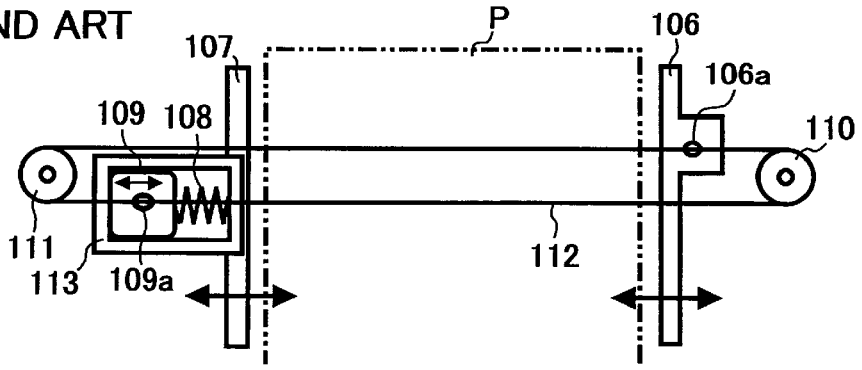
FIG. 7A BACKGROUND ART
FIGS. 7(A)–7(D) are illustrations for explaining an operation of sheet position adjustment in another background sheet guide device.
Figure 7B:
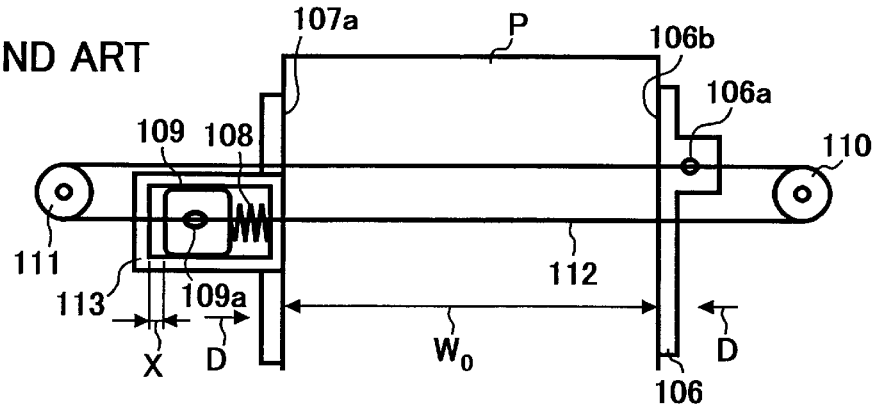
FIG. 7B BACKGROUND ART

Assuming that the difference of sheet size due to a cutting error is, for example, ±Z mm of the standard size, a maximum size of a sheet becomes "standard size +Z mm" and a minimum size becomes "standard size −Z mm". In this sheet guide device, a span between the side fences 106 and 107 is preset in accordance with a width of the minimum size sheet (i.e. "standard size −Z mm") and the bias force by the biasing device 108 is preset as zero relative to the minimum size sheet. FIG. 7(B) illustrates a case where the sheet P has the standard size W0, FIG. 7(C) illustrates a case where the sheet P has a maximum size W1 (the standard size +Z mm), and FIG. 7(D) illustrates a case where the sheet P has a minimum size W2 (the standard size −Z mm).

Next, an operation for sheet position adjustment in this sheet guide device is described. As illustrated in FIGS. 7(B) through 7(D), when the side fences 106 and 107 move in the direction indicated by an arrow D while being driven by the motor, inner edges 106*b* and 107*a* of the side fences 106 and 107 contact the sheet P and adjust its position widthwise in the sheet conveying path.

Figure 7C:
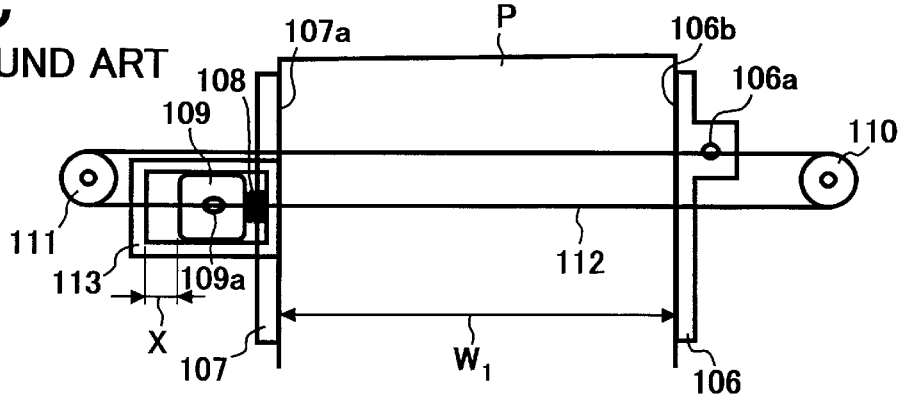
FIG. 7C BACKGROUND ART
Figure 7D:
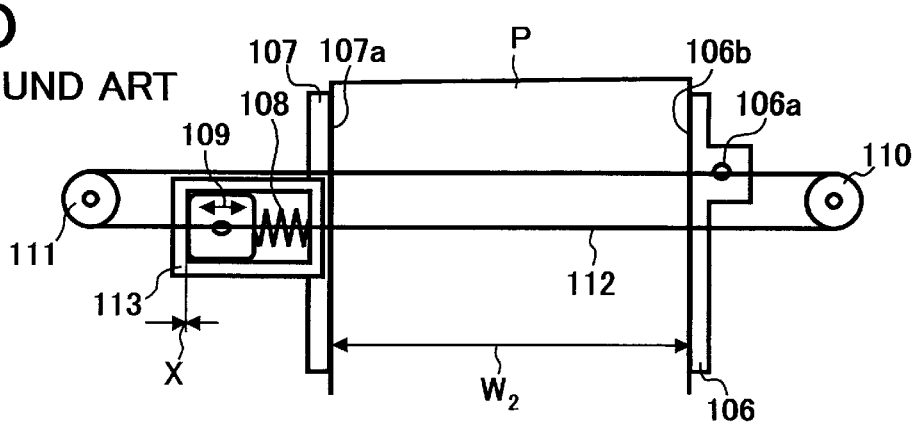
FIG. 7D BACKGROUND ART

Referring to FIG. 7(C), when the maximum size sheet (W1) is conveyed to the space between the side fences 106 and 107, the coupling portions 106*a* and 109*a* move inwardly and are driven by the motor such that the span between the side fences 106 and 107 becomes substantially equal to a width of the minimum size sheet (W2). Thereby, the inner edge 106*b* of the side fence 106 and the inner edge 107*a* of the side fence 107 contact the side edge of the maximum size sheet (W1). Thus, the sheet position is adjusted. When the inner edge 107*a* of the side fence 107 contacts the side edge of the maximum size sheet (W1), the side fence 107 receives a repulsive force from the maximum size sheet (W1) in the left direction in FIG. 7(C). As a result, the biasing device 108 contracts in the left direction due to the repulsive force of the maximum size sheet. At the same time, the biasing device 108 contracts also in the right direction due to a pushing force of the slider 109 which is driven by the motor via the coupling portion 109*a*. When the biasing device 108 is contracted by the above described two forces, i.e. the repulsive force of the maximum size sheet and the pushing force of the slider 109, the space X is produced between the frame 113 and the left side edge of the slider 109 by (1) movement of the frame 113 to the left due to the repulsive force of the maximum size sheet, and by (2) movement of the slider 109 to the right. Therefore, the width of the space X depends on the amount of the difference of the sheet size due to a cutting error. Accordingly, the space X becomes greatest for the maximum size sheet (W1) as illustrated in FIG. 7(C), becomes smaller for the standard size sheet (W0) as illustrated in FIG. 7(B), and becomes zero for the minimum size sheet (W2) as illustrated in FIG. 7(D). Thus, the problem of the difference of the sheet size due to a cutting error in adjusting the sheet position in the background sheet guide device is solved. In the above-described background sheet guide device, after a sheet position is adjusted as above, the sheet P is conveyed in the refeed direction when biased by the biasing device 108 as illustrated in FIGS. 7(B), 7(C) and 7(D), respectively. Therefore, the bias force of the biasing device 108 is small enough to avoid forming wrinkles in the sheet P when the sheet P is conveyed in the refeed direction.

Next, a case in which the sheet guide device having the above-described configuration is used in a curved sheet conveying path is explained. In the curved sheet conveying path illustrated in FIGS. 8(A) and 8(B), the sheet is bent by the conveying roller 101, as illustrated in FIG. 9. When the sheet P is bent in the conveying direction, the sheet P cannot be easily shifted widthwise because contact resistance F between the sheet P and a stack tray (not shown) provided in a stack path becomes greater as a part of the sheet P is passed under the conveying roller 101 and a part of the sheet P not passed under the conveying roller 101 is being pressed against the stack tray (not shown) provided in the stack path due to a repulsive force of the sheet P, compared to a case in which the sheet guide device is used in a horizontal sheet conveying path.

Figure 10A:
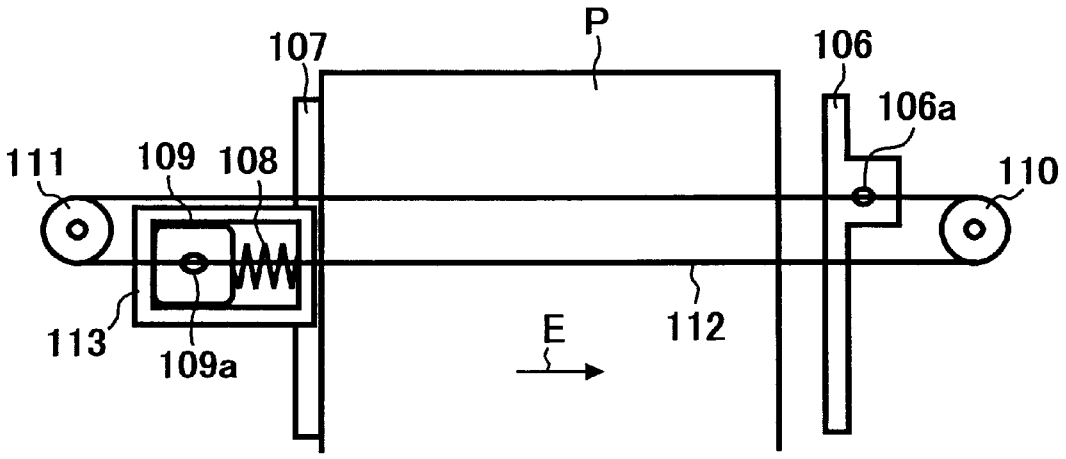
FIG. 10A BACKGROUND ART
FIGS. 10(A) and 10(B) are illustrations for explaining operations for sheet positioning adjustment of the background sheet guide device of FIGS. 7(A)–7(D), FIG. 10(A) being an illustration in a case of a horizontal sheet conveying path, and FIG. 10(B) being an illustration in a case of a curved sheet conveying path.
Figure 10B:
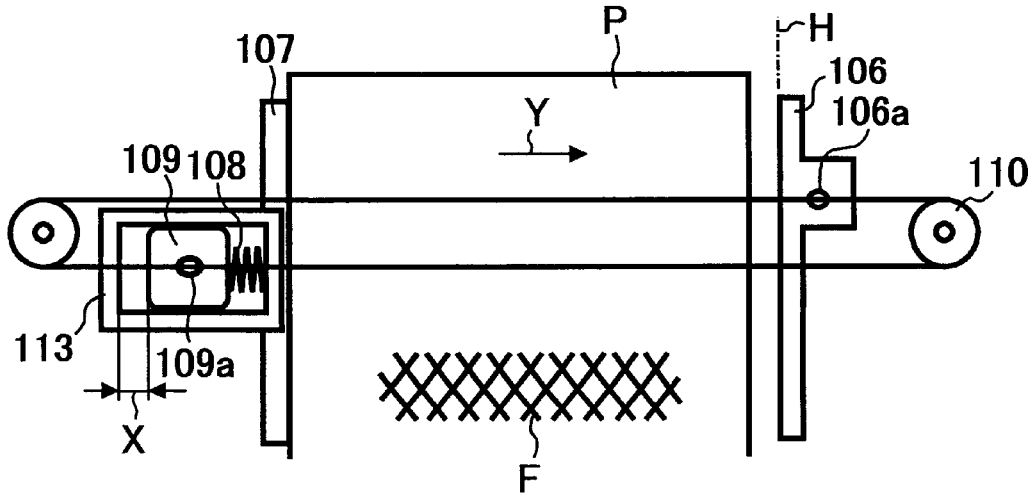
FIG. 10B BACKGROUND ART

Referring to FIGS. 10(A) and 10(B), in the horizontal sheet conveying path, the side fence 107 can easily shift the sheet P in the direction indicated by an arrow E, as illustrated in FIG. 10(A), because the sheet P is on the horizontal sheet conveying path and thereby the contact resistance F is small relative to the bias force of the biasing device 108. The reference character H in FIG. 10(B) designates a predetermined standard position of the side fence 106.

On the other hand, when the sheet P is bent in the conveying direction as illustrated in FIG. 9, the contact resistance F becomes relatively large as described earlier. In such a case, unless the bias force applied by the biasing device 108 is greater than the contact resistance F, the side fence 107 cannot shift the sheet P in the direction indicated by an arrow Y in FIG. 10(B), and the position of the sheet P may be deviated from the standard position H, as illustrated in FIG. 10(B). Therefore, when the sheet guide device of the above configuration is used in the curved sheet conveying path, the bias force of the biasing device 108 is desired to be made stronger in order to adjust the sheet P to the standard position H. As described above, the bias force of the biasing device 108 is set so as to absorb (1) the pushing force of the slider 109 and (2) the repulsive force of the sheet P corresponding to the space X. However, if the bias force applied by the biasing device 108 is made stronger, when the maximum size sheet is conveyed in the refeed direction after the position of the sheet P is adjusted with the stronger bias force, wrinkles are produced in the sheet P.

The sheet guide device in the second embodiment therefore is configured to be capable of adjusting the bias force of the biasing device 108 to avoid forming wrinkles in the sheet P when the sheet P is conveyed in the refeed direction regardless of the size of the sheet P and even when the size includes a cutting error. The second embodiment of the present invention is now described referring to FIGS. 11(A) through 11(D) as follows.

In the second embodiment, a sheet position is adjusted widthwise such that the center of the sheet P is aligned with the center of a span between a side fence 6 and a side fence 7, which corresponds to the center of the image writing part on the photoconductor drum. Provided integrally with the side fence 7 is a frame 75 which includes a first biasing device 71, a second biasing device 72, a slider 73 coupled with a belt 12 via a coupling portion 73*a*, and a relay member 74 therein. The relay member 74 is movable relative to the side fence 7 and the slider 73 is movable relative to the relay member 74.

The first biasing device 71 is supported by being sandwiched between the side fence 7 and the relay member 74, and the second biasing device 72 is supported by being sandwiched between the slider 73 and a concave part of a side of the relay member 74. Further, provided integrally with the side fence 6 opposed to the side fence 7 is a frame 63. The frame 63 includes a third biasing device 61, and a slider 62 which is coupled with the belt 12 via a coupling portion 62*a* and moves relative to the side fence 6. The third biasing device 61 is supported by being sandwiched between the side fence 6 and the slider 62. The belt 12 is driven by a motor (not shown) via a driven pulley 10 and a drive pulley 11.

In the sheet guide device of the second embodiment, the bias force applied by the first biasing device 71 (fm) is set to be strong enough to shift a sheet P which is bent in the sheet conveying direction and which thereby has great contact resistance as described above. The bias force of the second biasing device 72 (fs) and the third biasing device 61 (fs) is set to be weak enough to avoid producing wrinkles in the sheet P when the sheet P is conveyed in the refeed direction with the side edges of the sheet P being biased by the biasing devices 72 and 61. Further, the relation of the bias force between the first biasing device 71 (fm) and the second biasing device 72 or the third biasing device 61 (fs) is set to be: fm >>fs.

Figure 11A:
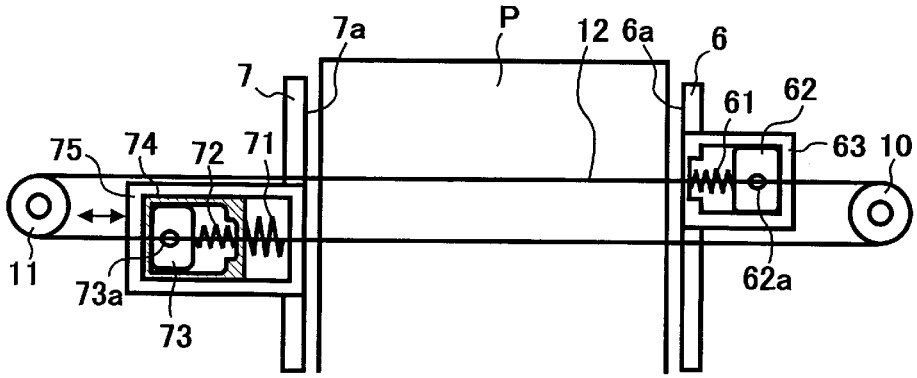
FIGS. 11(A)–11(D) are illustrations for explaining operations for sheet positioning adjustment of a sheet guide device according to a second embodiment of the present invention.
Figure 11B:
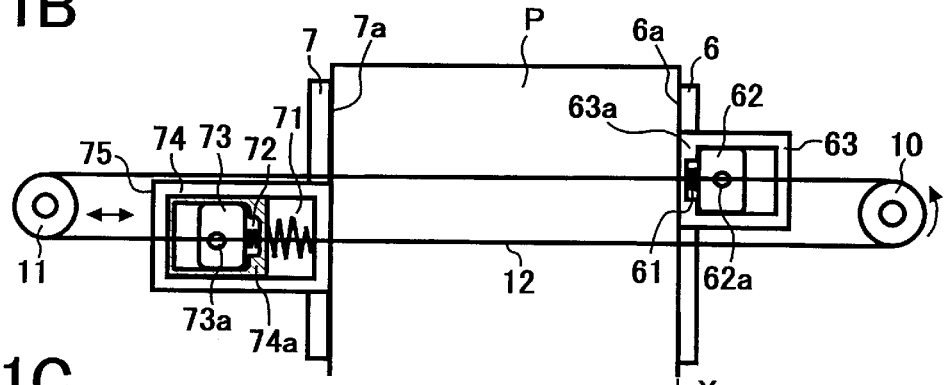

Next, an operation for sheet position adjustment in the sheet guide device of the second embodiment is described. In this sheet guide device, a span between the side fences 6 and 7 is preset in accordance with a width of the minimum size sheet, i.e. "the standard size Z" for each size (e.g. B5, A4, A3, etc.) of the sheet P as described earlier. In FIG. 11(A), when a sheet P is conveyed between the side fences 7 and 6, the coupling portions 73*a* and 62*a* move inwardly when they are driven by the motor via the belt 12 so that the side fences 7 and 6 likewise move inwardly to a predetermined position which is set corresponding to the minimum size sheet. Thereby, inner edges 7*a* and 6*a* of the side fences 7 and 6, respectively, contact the side edges of the sheet P. The second and third biasing devices 72 and 61 are configured so as to be completely contracted as illustrated in FIG. 11(B) when the side fences 7 and 6 move to the predetermined position. More in detail, the sliders 73 and 62 are driven via the coupling portions 73*a* and 62*a* to move towards the sheet P, and then abut on projected parts 74*a* and 63*a* of the relay member 74 and the frame 63, respectively. Then, the relay member 74 and the frame 63 are moved inwardly so that the side fences 7 and 6 are likewise moved inwardly to the predetermined position. Thereby, the position of the sheet P is adjusted such that the center of the sheet P is aligned with the center of the span between the side fences 7 and 6 as illustrated in FIG. 11(B).

When the sheet P is bigger than the minimum size sheet, for example, when the sheet P has the maximum size, each of the coupling portions 73*a* and 62*a* is driven to move inwardly, and the first biasing device 71 contracts due to two forces, i.e. a pushing force of the side fence 6 against the maximum size sheet P in the left direction, and a pushing force of the relay member 74 in the right direction by being driven by the motor via the slider 73. As a result, the maximum size sheet is shifted in the left direction by the space of X3 by the pushing of the side fence 6 in FIG. 11(C). Assuming that a difference of the sheet width between the maximum size sheet (the standard size +Z) and the minimum size sheet (the standard size −Z) is "2X", because the side fences 6 and 7 are preset to move such that the span between the side fences 6 and 7 becomes substantially equal to the width of the minimum size sheet (the standard size −Z), in FIG. 11 (C), a space of X3 equals to a half of the difference of the sheet width between the maximum and minimum size sheets, i.e. $2Z \times \frac{1}{2} = Z$. A space of X2 is produced between the frame 75 and the left side edge of the relay member 74 by (1) moving of the frame 75 towards the left with the first biasing device 71 being contracted in the left direction by the space of X3, and by (2) moving of the relay member 74 towards the right with the first biasing device 71 being contracted in the right direction by the space of X3. Accordingly, the space of X2 becomes two times the space of X3.

Figure 11C:
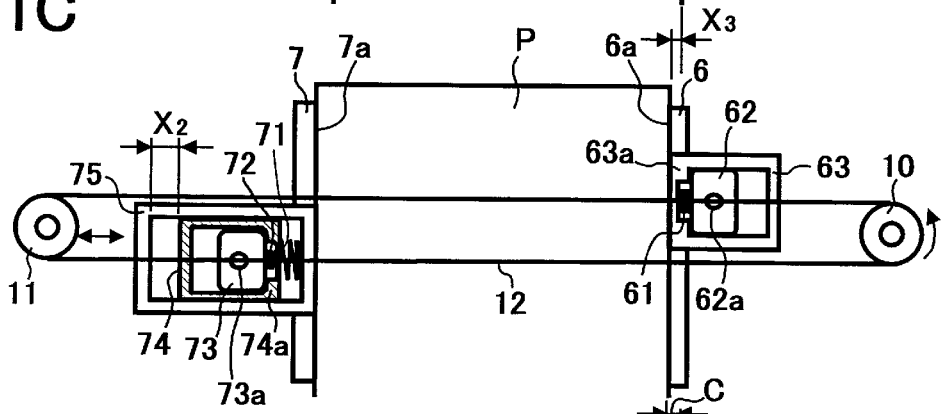

In the above described operation in FIG. 11(C), the first biasing device 71 contracts in the left direction due to the pushing force of the side fence 6 against the maximum size sheet P in the left direction, because the sheet P bent in the sheet conveying direction as illustrated in FIG. 9 has tension (fz) in the widthwise direction, and the pushing force of the side fence 6 is delivered to the side fence 7 via the maximum size sheet P having the tension (fz). Assuming that the tension of the sheet P is "fz" and the bias force of the first biasing device 71 is "fm", the bias force of the first biasing device 71 (fm) is set to satisfy the relation fm<fz in FIG. 11(C). Therefore, even though a relatively strong bias force by the first biasing device 71 is applied to both sides of the sheet P, bulges are not produced on the sheet P.

Figure 11D:
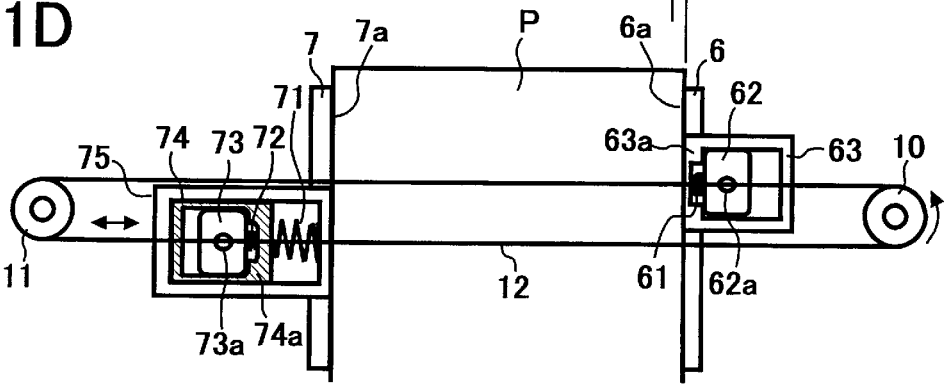

FIG. 11(D) illustrates a state when the maximum size sheet is conveyed in the refeed direction. Specifically, the maximum size sheet is shifted by a predetermined distance C (illustrated in FIG. 11(C)) in the right direction by moving the coupling portions 73*a* and 62*a* outwardly. The distance C for shifting the sheet P is preset in the sheet guide device. When the distance C is set to be equal, for example, to a half of the difference of the sheet width between the maximum size sheet (the standard size +Z) and the minimum size sheet (the standard size −Z), i.e. "Z", the side edges of the maximum size sheet return to the position before having been shifted in the left direction by being pushed by the side fence 6 as illustrated in FIG. 11(D). More in detail, while the coupling portions 73*a* and 62*a* are moving outwardly by the distance C (Z), the contracted first biasing device 71 expands completely by (1) pushing the relay member 74 in the left direction and (2) pushing the maximum size sheet to the side fence 6 in the right direction. As described earlier, the expanding bias force of the first biasing device 71 is set to be strong enough to shift the sheet P even when the sheet P is bent and thereby has great contact resistance. Therefore, the maximum size sheet is shifted in the right direction by the distance C. Specifically, the expanding bias force of the first biasing device 71 is desired to be greater than the contact resistance between the sheet P and the stack tray (not shown) provided in the stack path (illustrated in FIG. 9). After the maximum size sheet is pushed back to the right by the expanding force of the first biasing device 71, the sheet P is sandwiched securely between the side fences 6 and 7 for being conveyed in the refeed direction. As illustrated in FIG. 11(D), the first biasing device 71 has expanded completely and no bias force acts, even when the sheet P is the maximum size sheet. Therefore, even when the sheet P has the maximum size, the sheet P is conveyed without being wrinkled.

Figure 1B:
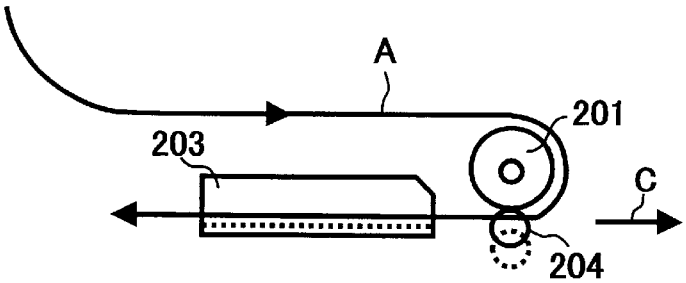
FIG. 1B BACKGROUND ART
Figure 2A:
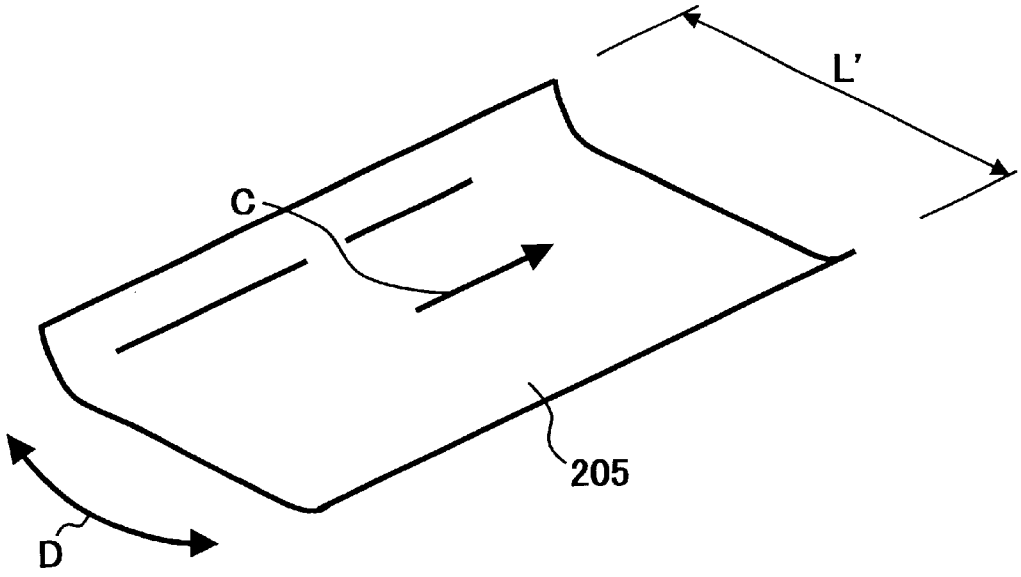
FIG. 2A BACKGROUND ART
FIGS. 2(A) and (B) are illustrations showing side curls of a sheet in the background duplex unit illustrated in FIGS. 1(A) and (B), FIG. 2(A) being a perspective view of the curled sheet, and FIG. 2(B) being a sectional view of the curled sheet and side fences.
Figure 2B:
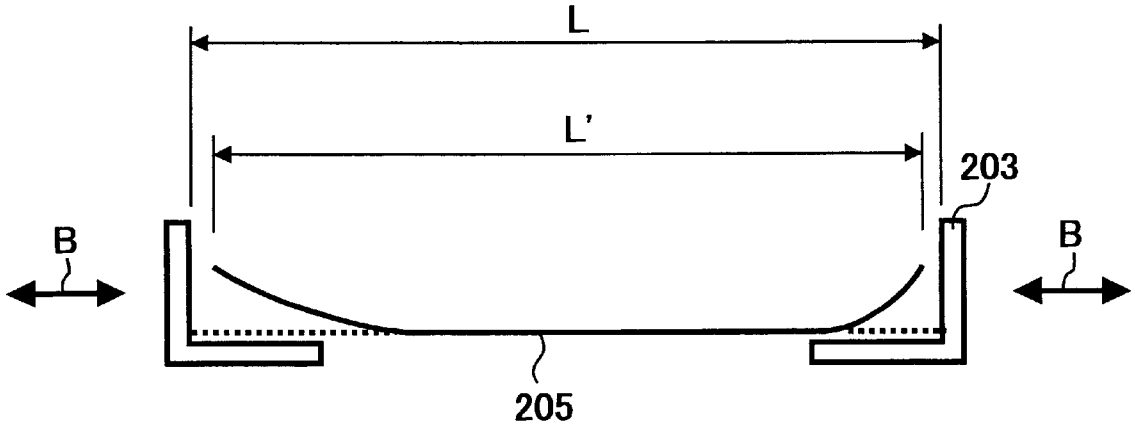
FIG. 2B BACKGROUND ART

In the case where the sheet P is a minimum size sheet, the side fences 6 and 7 move to stop at the predetermined position which is preset to be equal to the width of the minimum size sheet in FIG. 1(B). Therefore, the minimum size sheet does not need to be shifted in the left direction like the case of the maximum size sheet in FIG. 1I(C). Thereafter, the coupling portions 73*a* and 62*a* move outwardly by the predetermined distance C and then the minimum size sheet is conveyed in the refeed direction.

Figure 12A:
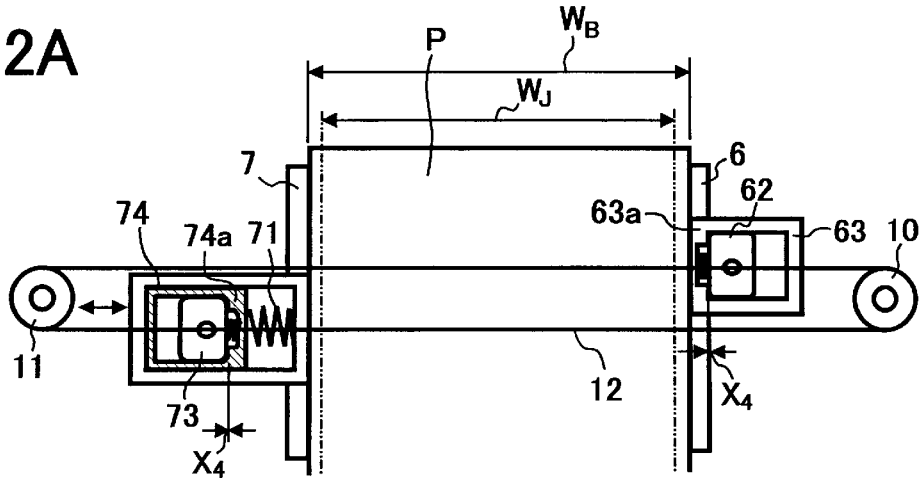
FIGS. 12(A)–12(C) are illustrations for explaining conditions of the sheet when the sheet is conveyed in the refeed direction in the second embodiment, FIG. 12(A) illustrating a case for a maximum size sheet, FIG. 12(B) illustrating a case for a standard size sheet, and FIG. 12(C) illustrating a case for a minimum size sheet.
Figure 12B:
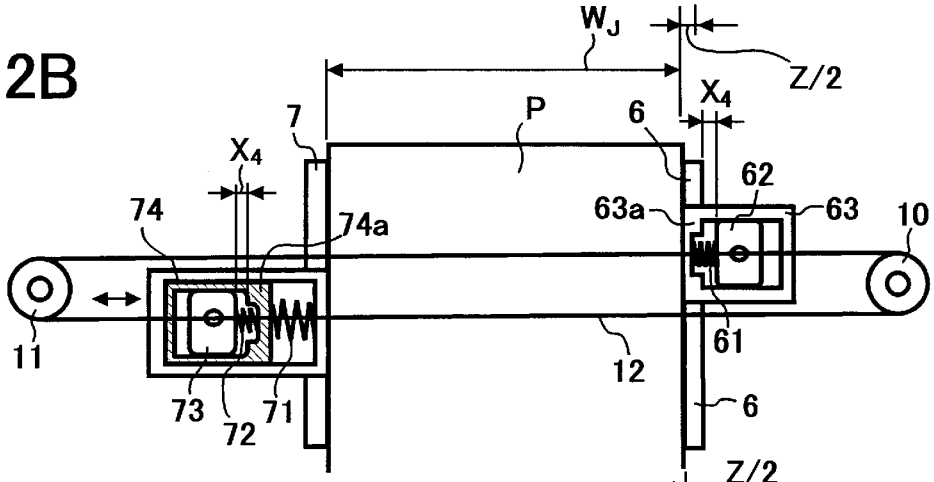
Figure 12C:
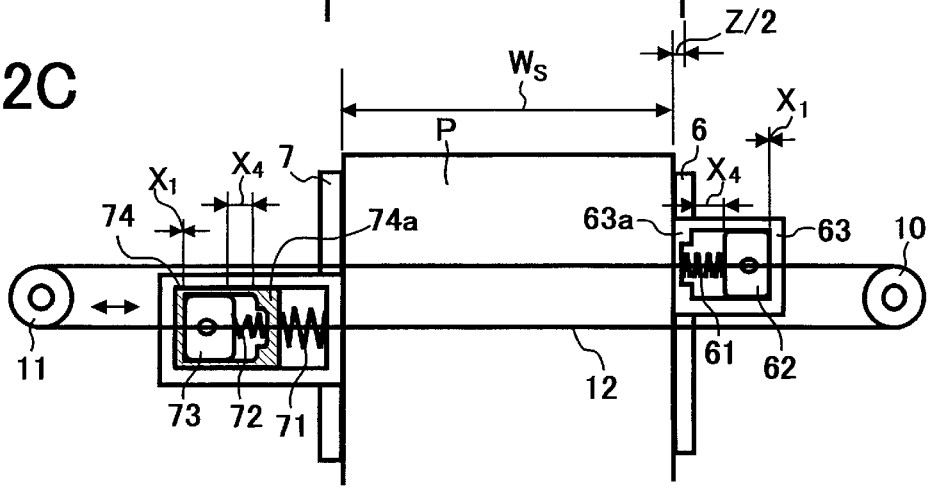

Next, referring to FIGS. 12(A), 12(B), and 12(C), a condition in which the sheet P is conveyed in the refeed direction (corresponding to FIG. 11(D)) is described. FIG. 12(A) illustrates a case when the sheet P has a maximum size (WB), FIG. 12(B) illustrates a case when the sheet P has a standard size (WJ), and FIG. 12(C) illustrates a case when the sheet P has a minimum size (WS). A space X4 in FIGS. 12(A), 12(B), and 12(C) designates a space between the slider 73 and the projected part 74*a* or the slider 62 and the projected parts 63*a*. The space X4 is produced when the coupling portions 73*a* and 62*a* move outwardly by the predetermined distance C in FIG. 11(C) and the second biasing device 72 and the third biasing device 61 expand in the outward directions in FIG. 11(C) to FIG. 11(D). When the distance C is set to be equal to the space X3 (i.e., "Z" as described earlier) in FIG. 11(C) and even when the sheet P is the maximum size sheet and the space of X4 becomes zero as illustrated in FIG. 12(A), only the second and third biasing devices 72 and 61 act on the sheet P and the first biasing device 71 does not act on the sheet P. Therefore, the sheet P having the maximum size can be conveyed without being wrinkled. The space X4 becomes "Z/2" for the standard size sheet (WJ) as illustrated in FIG. 12(B), and becomes "Z" for the minimum size sheet (WS) as illustrated in FIG. 12(C). Because the first biasing device 71 does not act on the sheet P either for the standard size or minimum size sheet, the sheet P having the standard or minimum size is also conveyed without being wrinkled. As a variation, the distance C may be set to satisfy the relation C≧Z in FIG. 11(C). In such a case, the space of X4 for the maximum size sheet (WB) becomes X4≧0 in FIG. 12(A), for the standard size sheet (WJ) becomes X.4>Z/2 in FIG. 12(B), and for the minimum size sheet (WS) becomes X4≧Z in FIG. 12(C). In this case, when the sheet P has the minimum size, a space of X1, i.e., the distance between the relay member 74 and the left side edge of the slider 73 or the distance between the frame 63 and the right side edge of the slider 62, satisfies the relation X1≧0 in FIG. 12(C). In other words, even when the sheet P is the minimum size sheet (WS), the sheet P is biased by the biasing devices 72 and 61 when the sheet P is conveyed in the refeed direction in FIG. 12(C), such that the sheet P is conveyed smoothly by being guided by the sheet guide device.

As described above, only the second and third biasing devices 72 and 61 act on the sheet P when the sheet P is conveyed in the refeed direction and extra bias force by the first biasing device 71 does not act on the sheet P. Therefore, occurrence of wrinkles on the sheet P can be obviated.

If the bias force applied by the first biasing device 71 acts on the sheet P (as illustrated in FIG. 11(C)) when the sheet P is conveyed in the refeed direction, wrinkles may be formed in the sheet P, because the above described relation between the tension of the sheet P (fz) and the bias force of the first biasing device 71 (fm) is reversed, i.e. fm>fz, after the force by a conveying roller (not shown) in the sheet refeed direction is added to the sheet P. In order for the sheet P to keep the adjusted sheet position and advance smoothly when the sheet P is conveyed in the refeed direction, biasing forces of the second and third biasing devices 72 and 61 are desired to be equal in FIGS. 11(D), 12(A), 12(B), and 12(C).

As a variation of a predetermined span between the side fences 6 and 7, when a span between the side fences 6 and 7 is preset to be "smaller than a width of the minimum size sheet", i.e. the span<"the standard size −Z", the space of X3 in FIG. 11(C) becomes larger than X and the distance C in FIG. 11(C) becomes larger than Z in FIG. 11(C). Therefore, even when the sheet P has the minimum size, the sheet P is shifted to the right direction to abut on the side fence 6 and thereby the sheet P is positioned more accurately.

Thus, in the second embodiment, with the provision of the third biasing device 61 on the side fence 6, an accurate sheet position adjustment is achieved also in the curved sheet conveying path such that the center of a sheet P is aligned with the center of a span between the side fence 6 and the side fence 7.

Moreover, the sheet guide device is configured such that the first biasing device 71 serves to shift the sheet P in the right direction, so that the sheet P can be adjusted to the precise position, even if the sheet P has great contact resistance in the curved sheet conveying path.

Further, in the second embodiment, the side fence 6 in FIGS. 11(A) through 11(D) may be fixed at a standard position side to achieve substantially the same effects as in the case where both of the side fences 6 and 7 are moved to align the center of the sheet P with the center of the span between the fences 6 and 7.

Figure 8A:
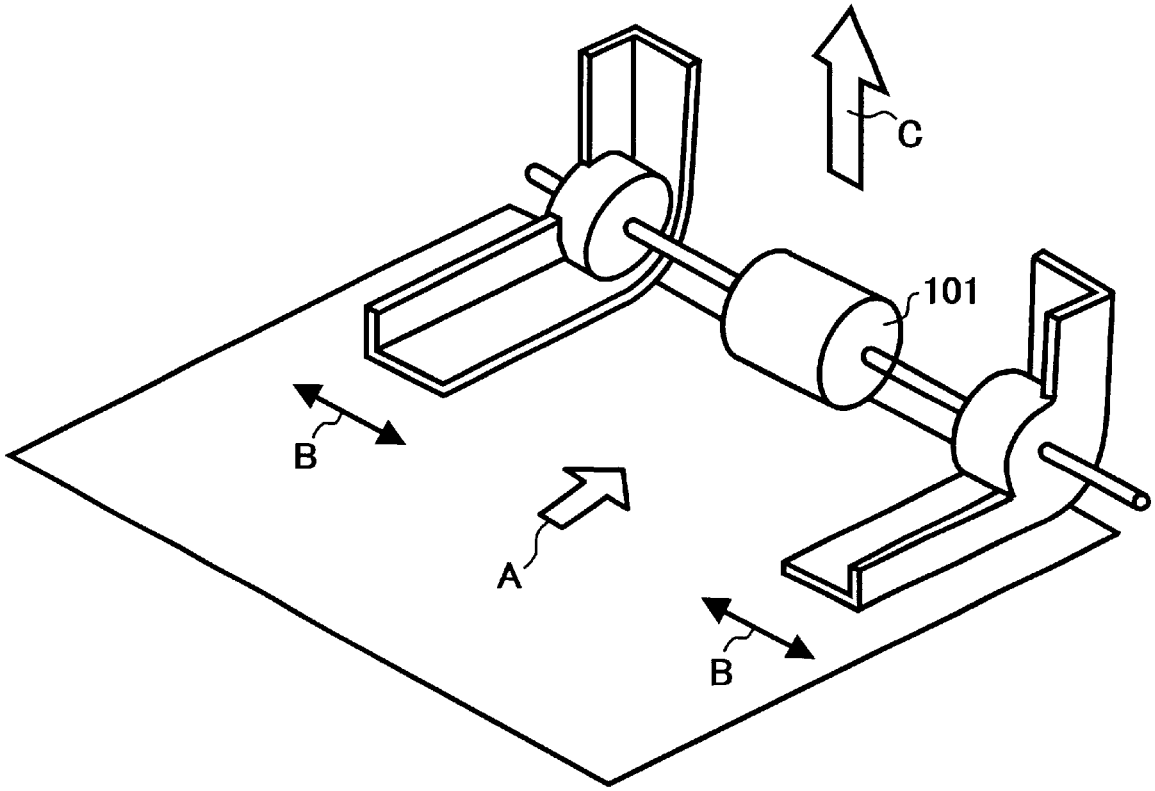
FIGS. 8(A) and 8(B) are illustrations for explaining a curved sheet conveying path of a sheet guide device, FIG. 8(A) being a perspective view of the sheet guide device, and FIG. 8(B) being a side view of the sheet guide device.
Figure 8B:
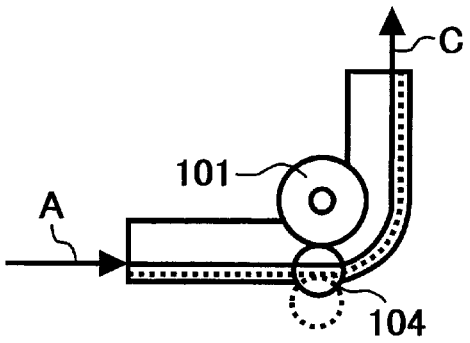
Figure 9:
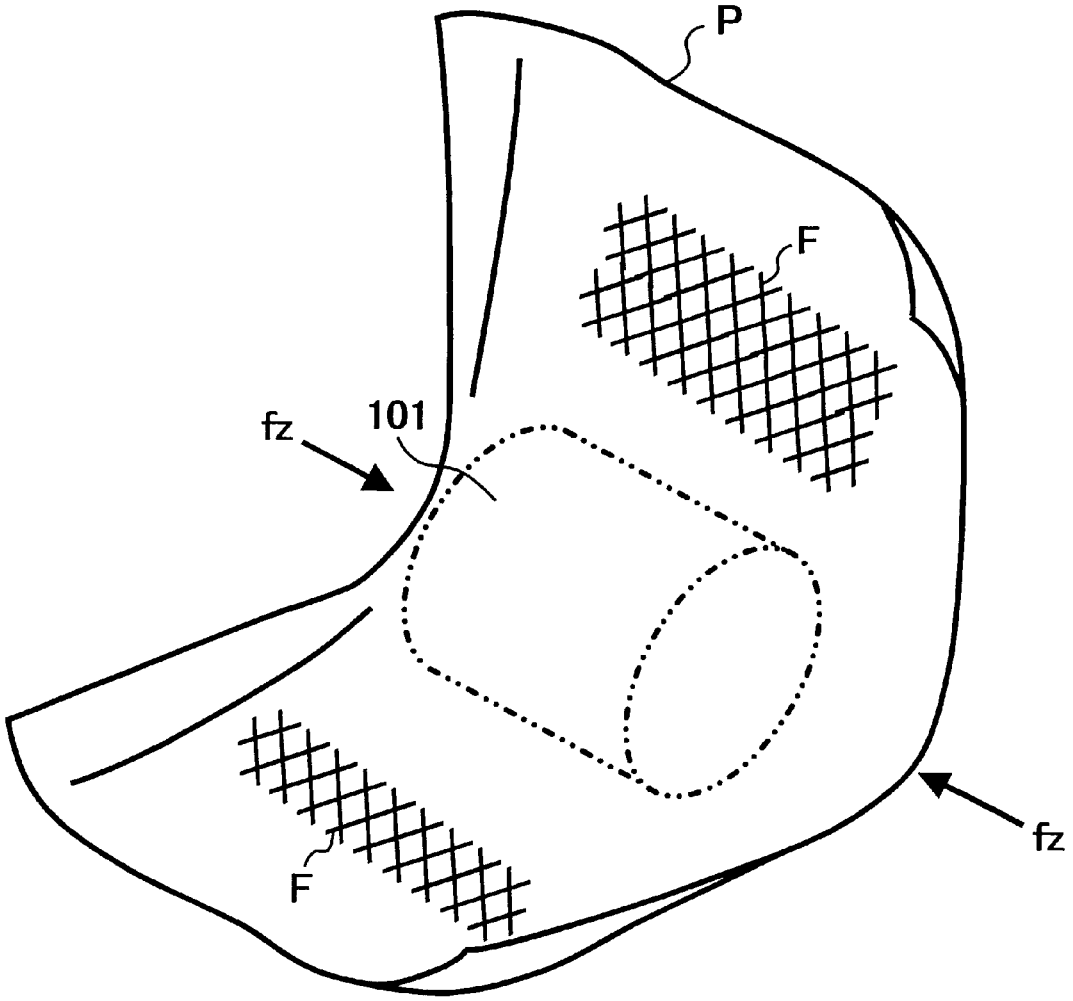
FIG. 9 is an illustration for explaining contact resistance of a sheet in a curved sheet conveying path.
Figure 13:
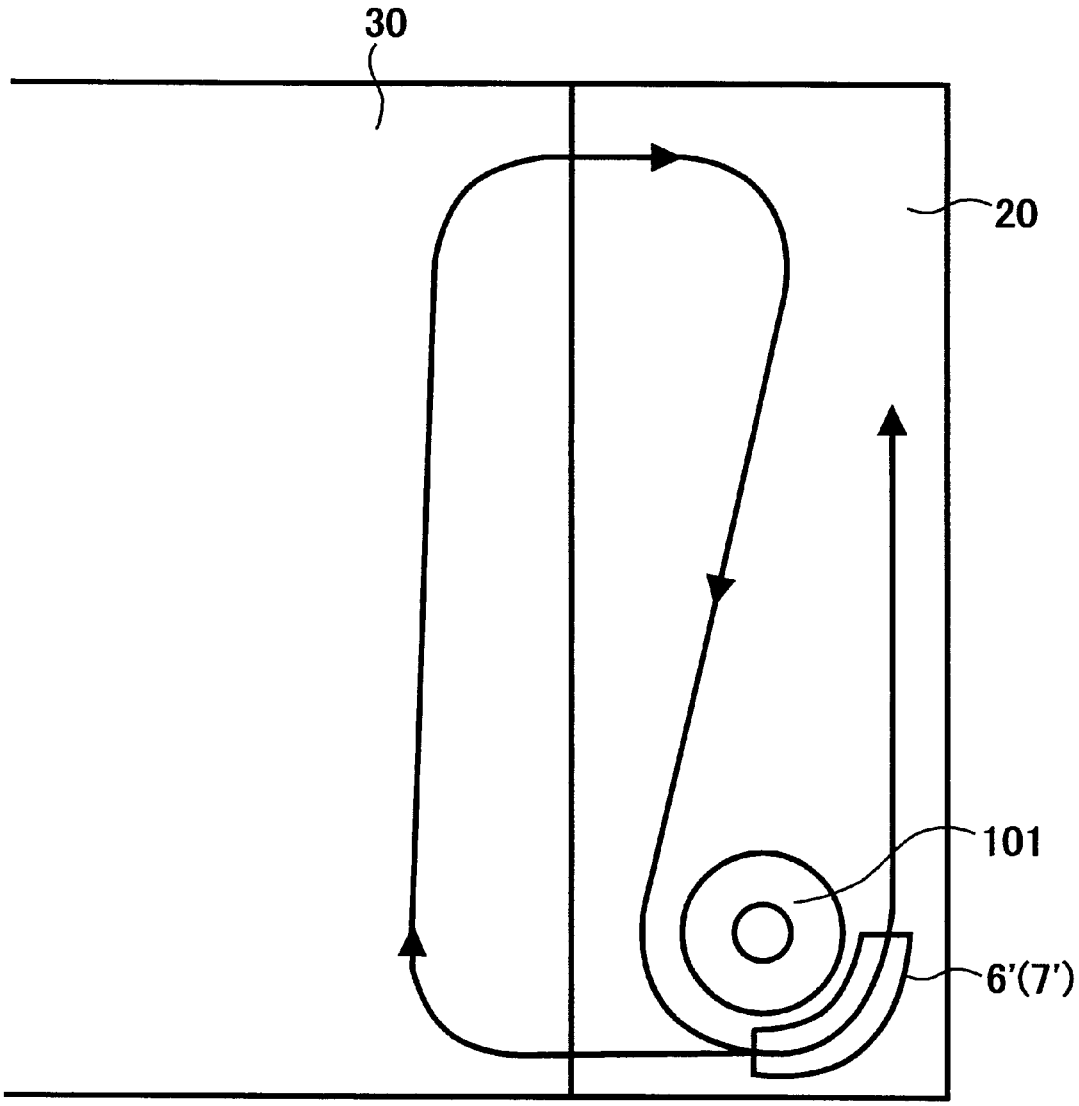
FIG. 13 is an illustration of a duplex unit of an image forming apparatus to which the sheet guide device of the second embodiment is applied.

Furthermore, the sheet guide device of the second embodiment can be applied not only to the curved sheet conveying path illustrated in FIG. 8(A) but also to a reverse sheet conveying path in a duplex unit illustrated in FIG. 13.

FIG. 13 illustrates a duplex unit of an image forming apparatus in which the sheet guide device of the second embodiment is utilized. A duplex unit 20 is provided next to a main body of an image forming apparatus 30 and includes the conveying roller 101 and curved side fences 6' and 7'.

Still furthermore in the second embodiment, for the first, second and third biasing devices, rubber or a combination of spring and rubber may be used to obtain substantially the same effects as those obtained with the spring.

Figure 14:
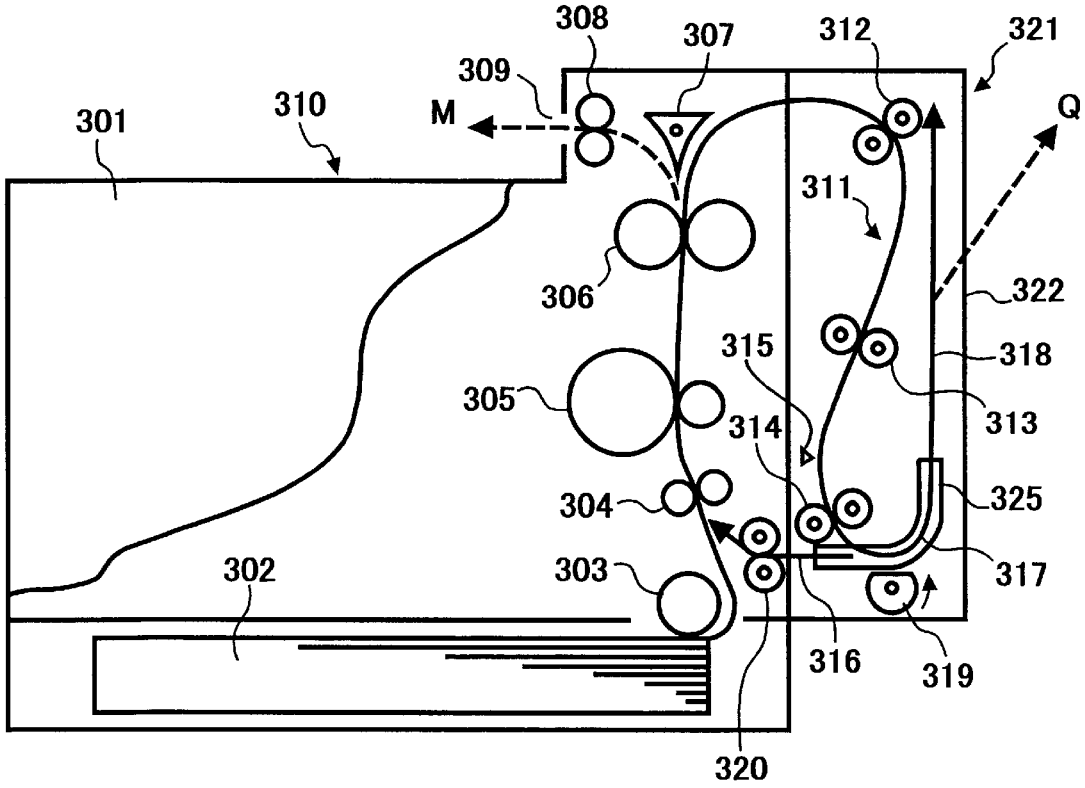
FIG. 14 is a schematic longitudinal sectional view of an image forming apparatus and a duplex unit according to a third embodiment.

Hereinafter, there will be described a third embodiment in which the aforementioned sheet guide device is used for guiding a sheet in a curved reversing path in a duplex unit. Referring to FIG. 14, a duplex unit 321 is provided at one side (right side as viewed in FIG. 14) of an image forming apparatus 301 such as a copying machine and a laser printer. Though the detail will be described later, a curved reversing path 317 is disposed in the duplex unit 321. Further, the image forming apparatus 301 includes a sheet feed tray 302 for accommodating sheets at a lower part thereof, a photoconductor drum 305 at a substantially central part thereof, and a stacker 310 for stacking discharged sheets at an upper part thereof.

First, an operation of one-sided copying in the image forming apparatus 301 is described in FIG. 14.

A sheet in the sheet feed tray 302 is fed out by a feed roller 303, and is conveyed to the photoconductor drum 305 after sheet skew is corrected by registration rollers 304. Then, a toner image is transferred to the sheet from the photoconductor drum 305, and is fixed to the sheet with fixing rollers 306. In a one-sided copy mode, the sheet is discharged from a discharging outlet 309 by discharging rollers 308 in the direction indicated by a dotted line M and is stacked on the stacker 310. Thus, the ordinary one-sided copy operation is completed.

In a two-sided copy mode, the sheet carrying an image on one side thereof, which has passed through the fixing rollers 306, is switched to be conveyed to the duplex unit 321 by the operation of a flapper 307. Specifically, when the two-sided copy mode is selected, the flapper 307 moves in the clockwise direction to switch the sheet conveying path towards the duplex unit 321, i.e. in the direction indicated by a solid line. Then, inside the duplex unit 321, the sheet is further conveyed to the position of first sheet conveying rollers 314 via first intermediate sheet conveying rollers 312, a first sheet conveying guide 3 11, and second intermediate sheet conveying rollers 313.

Figure 15:
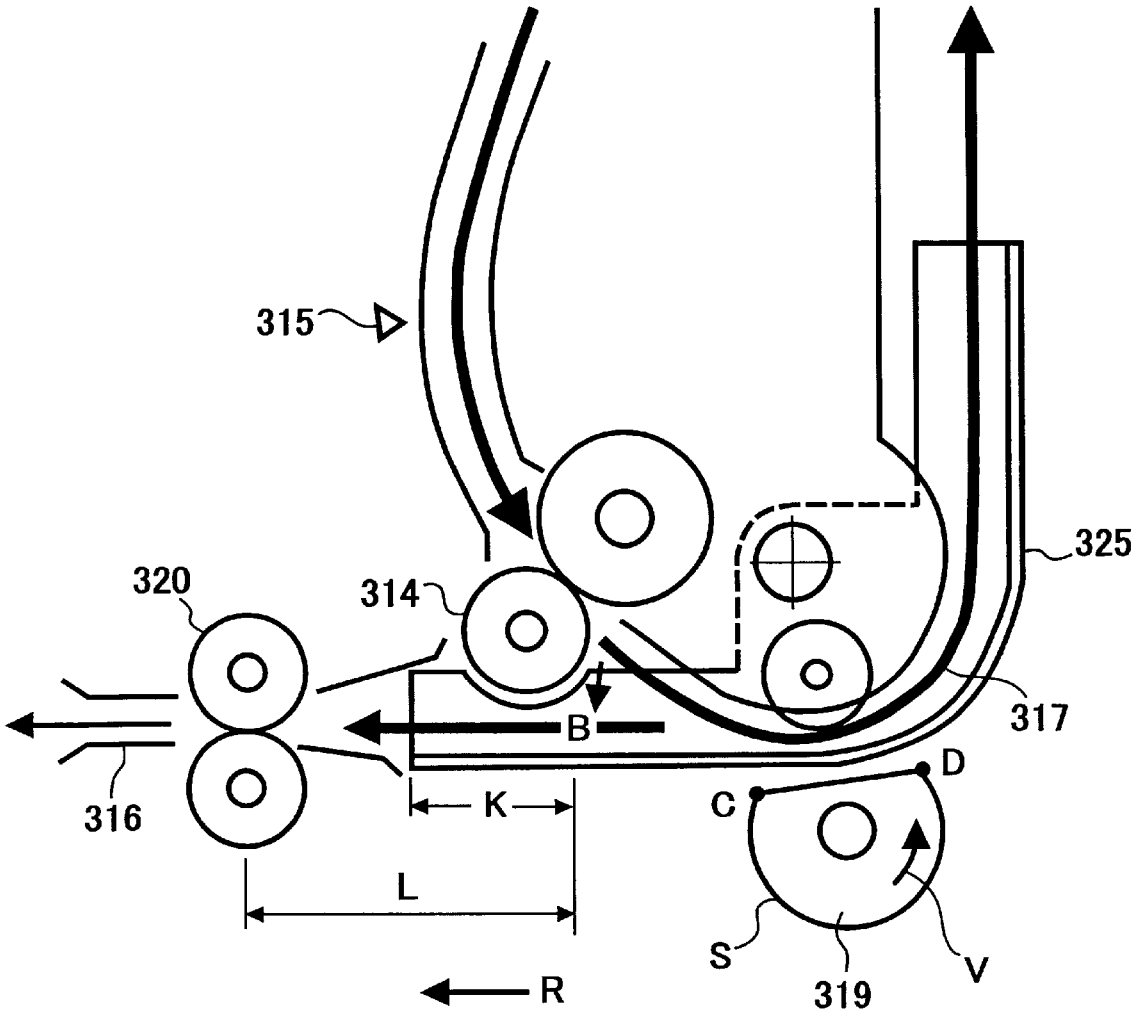
FIG. 15 is a magnified view of a main part of the duplex unit illustrated in FIG. 14.

Between the second intermediate sheet conveying rollers 313 and the first sheet conveying rollers 314, a sheet sensor 315 is disposed to control timing for conveying the sheet. Specifically, timing for driving and stopping the first and second intermediate sheet conveying rollers 312 and 313 and the first sheet conveying rollers 314 is controlled, such that a succeeding sheet stops and waits at the first sheet conveying guide 311 before entering the curved reversing path 317. After having been conveyed to the position of the first sheet conveying rollers 314, the sheet is further conveyed to the curved reversing path 317 which is curved, for example, at approximately 90°. The leading edge of the sheet advances upwardly along the curved reversing path 317 to a stack path 318, until the trailing edge of the sheet passes through a nip portion of the first sheet conveying rollers 314 and falls down to a flat portion B illustrated in FIG. 15 in the curved reversing path 317. The sheet is stacked temporarily there. In the case of a large size sheet, the leading edge of the sheet may be discharged out of the image forming apparatus 301 in the direction indicated by a dotted line Q in FIG. 14 when a sheet exit 322 opened. Then, lateral deviation of the sheet resulting from sheet skew is adjusted by moving jogger fences 325 which are also curved at approximately 90° like the curved reversing path 317. As illustrated in FIG. 15, a part-circular reverse conveying roller 319 is disposed below the curved reversing path 317. As the reverse conveying roller 319 contains a one rotation clutch inside thereof, it has a function of rotating only in the direction V in FIG. 15, i.e. in the counterclockwise direction. This rotating direction V leads the sheet conveying direction to a main body of the image forming apparatus 301, so that the reverse conveying roller 319 enables the sheet to be conveyed in a switchback direction. That is, when the reverse conveying roller 319 is rotated and a circular part of the roller 319 contacts an opposed roller, the sheet is conveyed in the direction indicated by an arrow R in FIG. 15 with the trailing edge of the sheet turning to be the leading edge. Because the part-circular reverse conveying roller 319 is used instead of a reversible roller in the third embodiment, it is not necessary to make two facing rollers contact or separate from each other to add or release pressure for conveying the sheet to the curved reversing path 317 and jogging the sheet by the jogger fences 325 for adjusting the sheet position. As a result, the mechanism for reversing the sheet and for jogging the sheet in the duplex unit 321 is made simple and the cost is reduced. The shape of the reverse conveying roller 319 is not limited to the part-circular shape in the illustrative embodiment and different shapes other than a round shape may be also applicable.

Referring again to FIG. 15, the reference character S designates an outer circumference of the reverse conveying roller 319 (from point C to point D) which the sheet directly contacts (hereinafter called an outer circumference S). The reference character L designates a distance between a fall point, in which the trailing edge of the sheet (i.e. the leading edge of the sheet in the reversed direction) falls after passing through the first sheet conveying rollers 314 and a nip portion of the second conveying rollers 320. The length of the outer circumference S corresponds to a distance the sheet is conveyed by one rotation of the reverse conveying roller 319 and may be set to be longer than the distance L (S>L), so that the leading edge of the sheet passes through the second conveying rollers 320 by one rotation of the reverse conveying roller 319. Thereby, distance and time for conveying a sheet inside the duplex unit 321 is reduced and the sheet is surely conveyed to the main body of the image forming apparatus 301 with a simple operation.

Alternatively, the outer circumference S may be set to satisfy the condition of 2S>L>S so that the leading edge of the sheet passes through the second conveying rollers 320 by two rotations of the reverse conveying roller 319. In this case, the sheet is conveyed before the second conveying rollers 320 by the first rotation of the reverse conveying roller 319. Then, the jogger fences 325 jog the sheet to adjust lateral deviation of the sheet resulting from sheet skew. Thereafter, the second rotation of the reverse conveying roller 319 conveys the sheet farther and the leading edge of the sheet passes through the second conveying rollers 320. Because the distance of the sheet jogged by the jogger fences 325 is longer by a distance "K" in the case of two rotations of the reverse conveying roller 319, the sheet position can be adjusted more accurately and the sheet can be conveyed towards the main body of the image forming apparatus 301 smoothly.

The distance L can be varied to the distance between the fall point in which the trailing edge of the sheet (i.e. the leading edge of the sheet in the reverse direction) falls after passing through the first sheet conveying rollers 314 and a nip portion of the registration rollers 304. In this case, because the jogger fences 325 jog the sheet at the position closer to the center of the sheet length, the sheet position is adjusted efficiently.

Figure 16A:
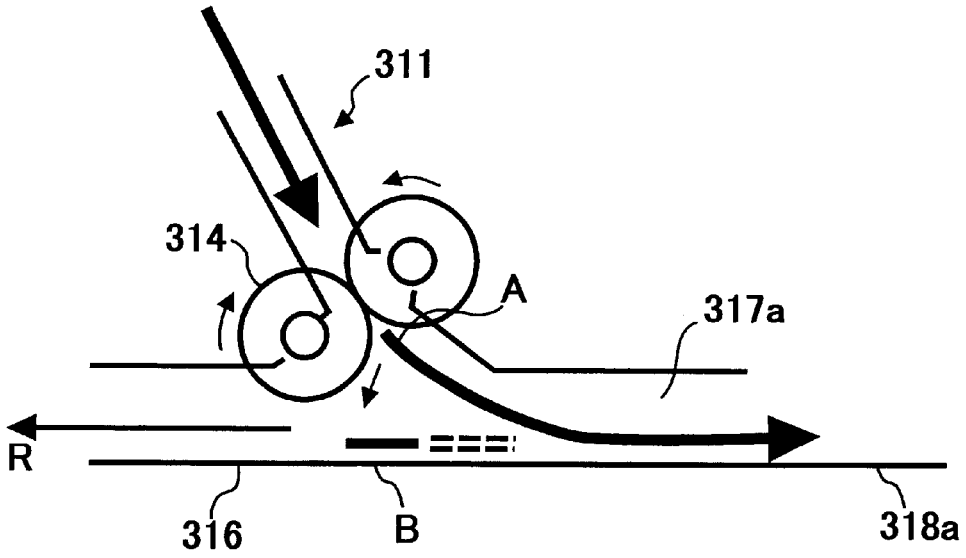
FIGS. 16(A) and 16(B) are illustrations for comparing horizontal and curved switchback conveying paths.
Figure 16B:
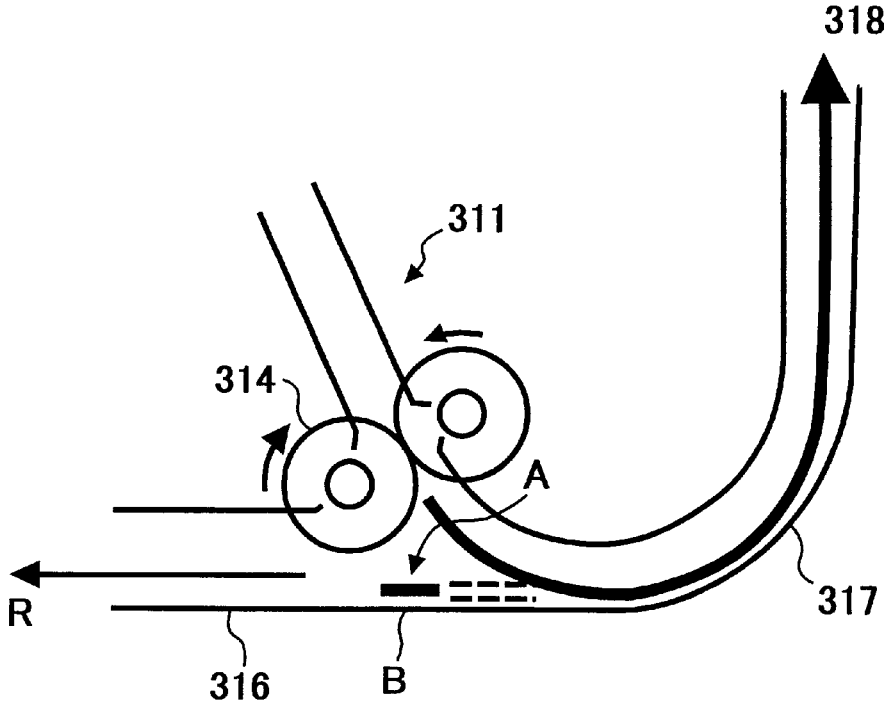

Next, an advantage of the curved reversing structure is explained with reference to FIG. 16(A) and FIG. 16(B). In FIG. 16(A), a sheet is conveyed by the first sheet conveying rollers 314 to be placed in a stack path 318*a*. The sheet is then reversed by a reversing roller (not shown) in the direction indicated by an arrow R. A sheet reverse conveying path 317*a* extends horizontally to a second conveying guide 316 below the first sheet conveying rollers 314. If a sheet after passing through the first sheet conveying rollers 314 is upwardly curled at the trailing edge part, the curled trailing edge of the sheet may remain at A point instead of falling down to B point, and the sheet may not be smoothly conveyed in the direction indicated by the arrow R. On the other hand, in the third embodiment, as illustrated in FIG. 16(B), the first sheet conveying rollers 314 are provided at an intersection of the first sheet conveying guide 311 and the second conveying guide 316. Note that the sheet reverse conveying path after the first sheet conveying rollers 314 is curved at approximately 90°. Thus, one side of the curved reversing path 317 extends vertically to the stack path 318*a* and another side extends horizontally in the direction indicated by the arrow R in FIG. 16(B). Owing to the above-described curved reversing path 317, even though the trailing edge part of the sheet is greatly curled upward, it falls down from point A to point B, because the sheet is bent at approximately 90° in the conveying direction in the curved reversing path 317 and is pressed against the flat portion (point B) in the curved reversing path 317 due to a repulsive force of the sheet. Accordingly, the sheet can be smoothly conveyed in the reversed direction. In order to enhance the above-described advantage, the curvature of the curved reversing path 317 should be set greater than an estimated maximum curvature of a curled sheet.

Figure 17:
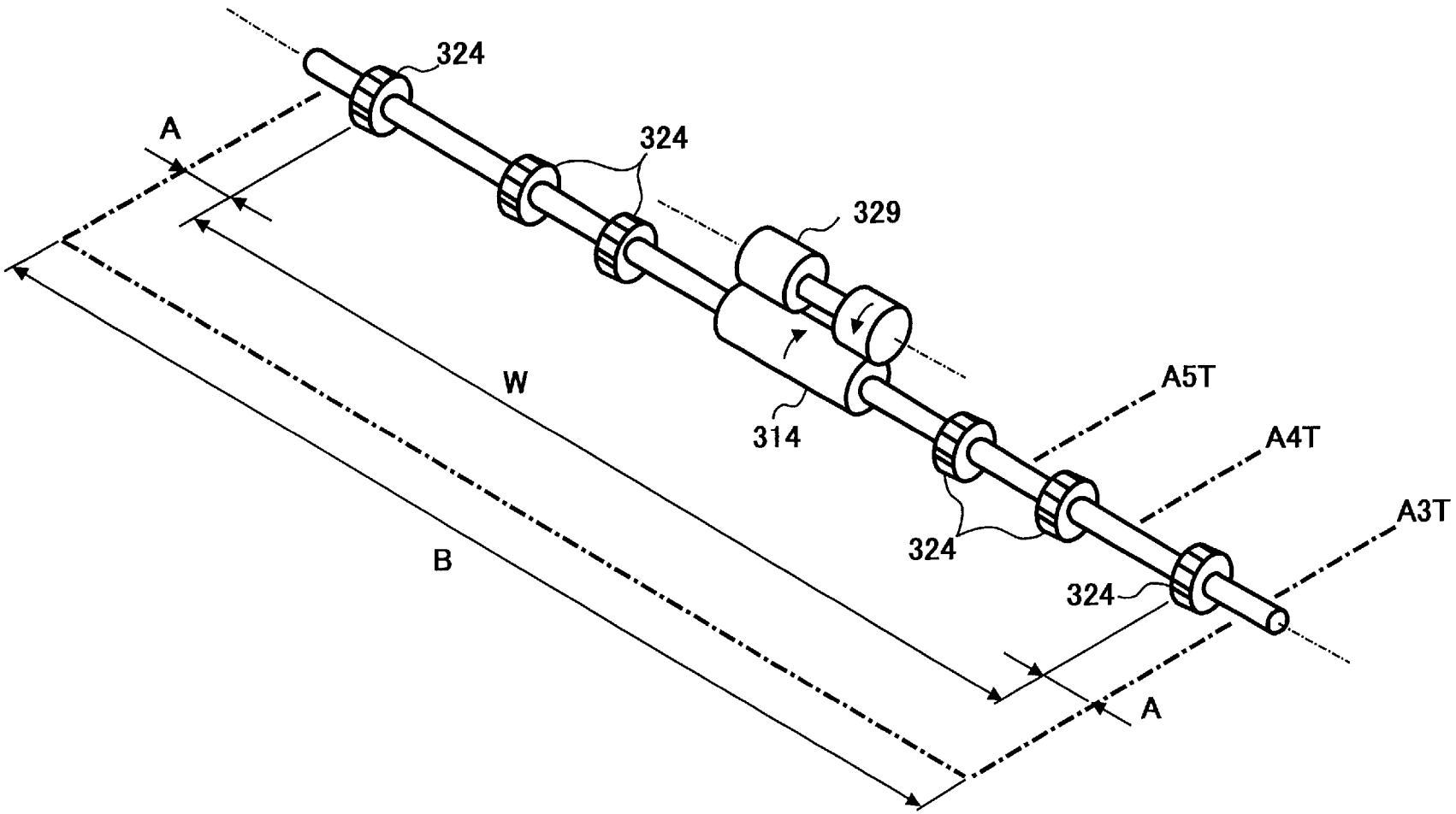
FIG. 17 is a perspective view of a configuration of a conveying roller and guide roller used in the sheet guide device according to the third embodiment.
Figure 18:
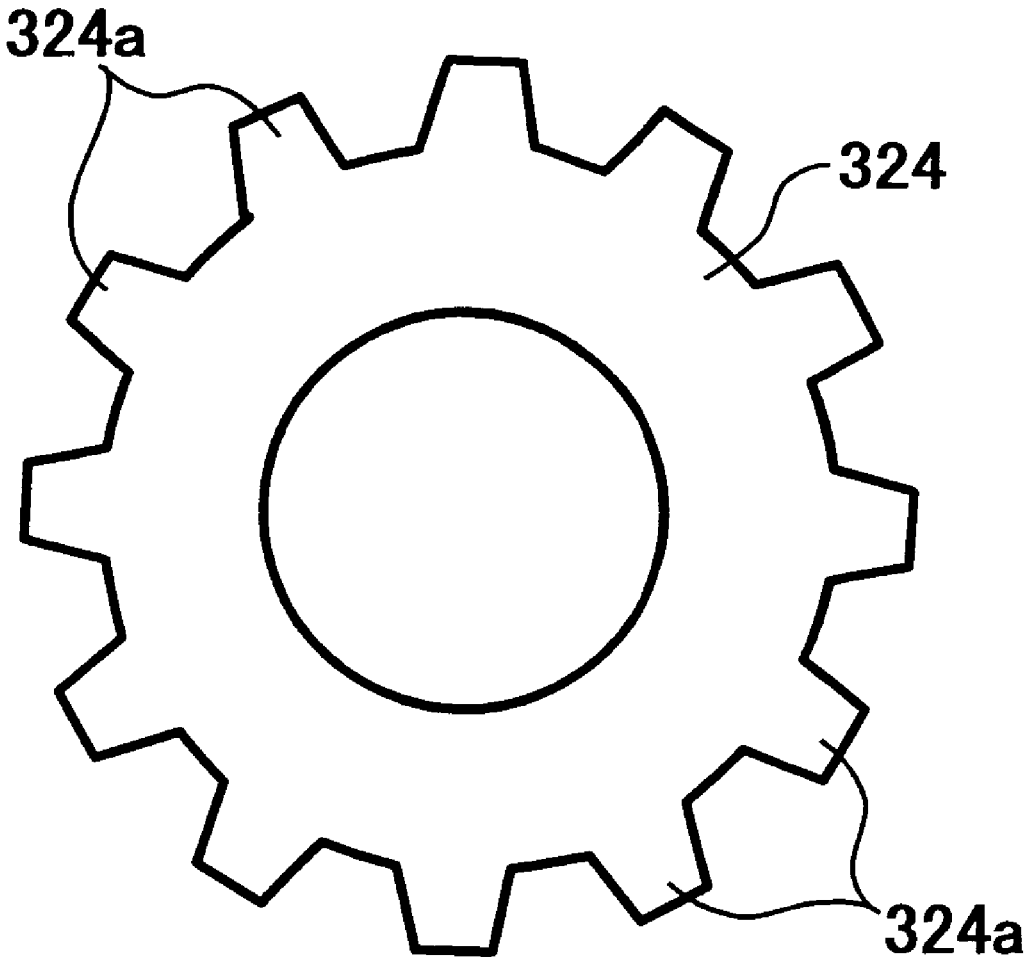
FIG. 18 is a magnified front view of a guide roller illustrated in FIG. 17.
Figure 19A:
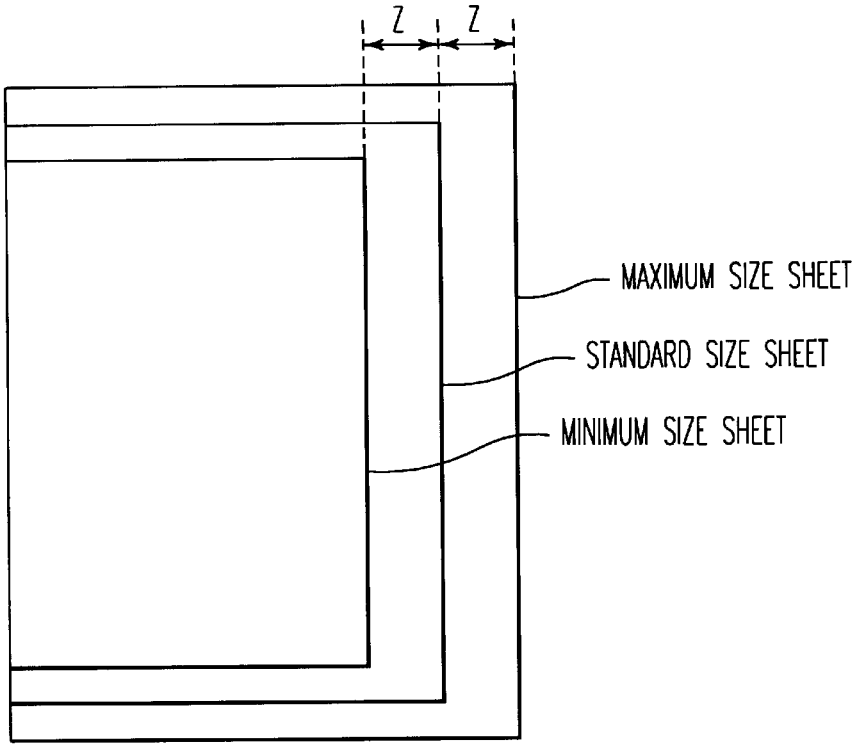
FIGS. 19(A) and 19(B) are illustrations for comparing the maximum, standard and minimum size sheets.
Figure 19B:
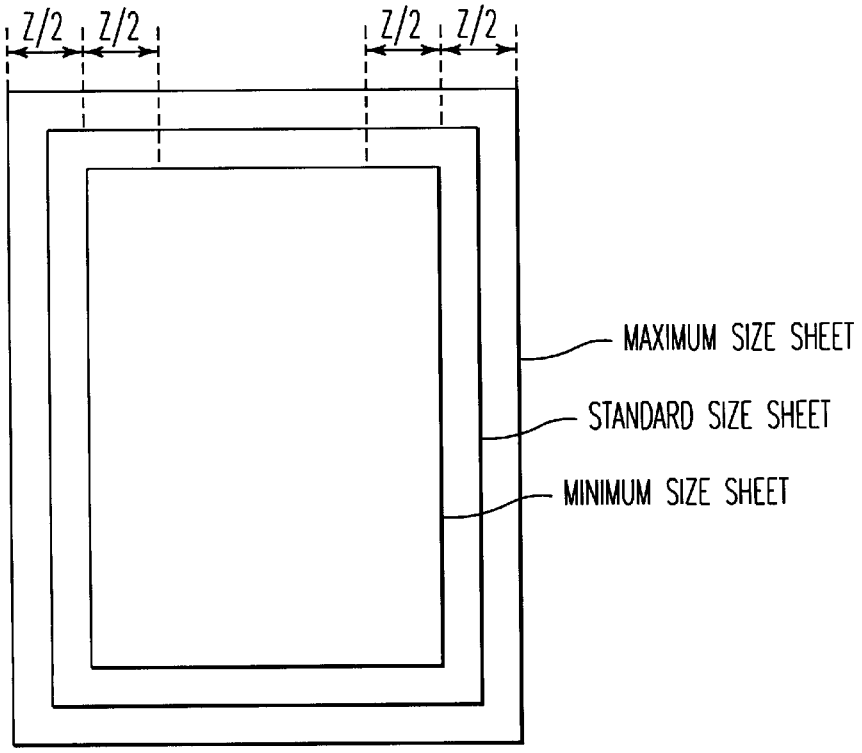

Turning now to FIG. 17, a plurality of guide rollers 324 is provided on an axis of the first sheet conveying roller 314. Six guide rollers 324 are illustrated as an example in FIG. 17. The guide rollers 324 are arranged within a maximum sheet width. Assuming that the maximum sheet width is B, and a distance between the outermost positioned guide rollers 324 is W, a distance between an edge of the maximum size sheet and the guide roller 324 at the outermost position A may be set, for example, in a range of 5 mm to 10 mm. By this arrangement, the guide rollers 324 serve to convey the sheet with both ends of the sheet guided accurately. The reference characters A3T, A4T and A5T designate positions where an edge of sheets of A3 size, A4 size, and A5 size are positioned when the sheets are conveyed in portrait orientation. The circumferential surface of the guide roller 324 is made uneven so as to securely support and convey the sheet. For example, as illustrated in FIG. 18, a plurality of guide protrusions 324*a* may be formed on the circumferential surface of the guide roller 324 to support and convey the sheet securely.

Referring back to FIG. 14, the sheet conveyed in the reversed direction is further conveyed to pass the registration rollers 304 to the position facing the photoconductor drum 305 by the second conveying rollers 320. Then a toner image is transferred to the backside of the sheet. After the leading edge of the reversed sheet passes through the second conveying rollers 320 by the rotation of the reverse conveying roller 319, the sheet is stopped and placed in a standby condition. While the sheet is being stopped, a succeeding sheet can enter the curved reversing path 317 by the first sheet conveying rollers 314. The sheet entering the curved reversing path 317 is conveyed along the same path as the preceding sheet being positioned in the curved reversing path 317. Thus, the sheets can pass each other in the curved reversing path 317, so that between-sheet timing can be reduced and productivity in a two-sided copy mode can be increased almost to a level found in a one-sided copy mode.

Obviously, numerous additional modifications and variations of the present invention are possible in light of the above teachings. It is therefore to be understood that within the scope of the appended claims, the present invention may be practiced otherwise than as specifically described herein.

What is claimed as new and desired to be desired by Letters Patent of the United States is:

1. A sheet guide device to guide a sheet being conveyed in a sheet conveying path of the device, comprising:

a device configured to adjust widthwise sheet positioning by regulating side edges of the sheet, wherein the adjusting device is provided in a curved part of the sheet conveying path; and a sheet conveying roller to convey the sheet, wherein the adjusting device is positioned on a shaft of the sheet conveying roller and is slidable along the shaft.

2. The sheet guide device according to claim 1, wherein the sheet conveying roller reverses a conveying direction of the sheet.

3. The sheet guide device according to claim 1, wherein a guide member to guide the side edges of the sheet is unitarily provided for the adjusting device.

4. A sheet guide device to guide a sheet being conveyed in a sheet conveying path of the device, comprising:

a device configured to adjust widthwise sheet positioning by regulating side edges of the sheet, wherein the adjusting device is provided in a curved part of the sheet conveying path;

wherein said adjusting device is a first guide member provided in the sheet conveying path to adjust sheet positioning by regulating a side edge of the sheet, the first guide member being movable widthwise according to a sheet size;

a first biasing device to absorb a difference in size of the sheet due to a cutting error of the sheet when the sheet positioning is adjusted; and a second biasing device to bias the side edge of the sheet in accordance with a variance in the size of the sheet when the sheet is conveyed;

wherein the first biasing device and the second biasing device are provided for the first guide member.

5. The sheet guide device according to claim 4 further comprising:

a second guide member being paired with the first guide member to adjust the sheet positioning by regulating an opposite side edge of the sheet, the second guide member being movable widthwise according to the sheet size; and a third biasing device to bias the opposite side edge of the sheet in cooperation with the second biasing device when the sheet is conveyed;

wherein the third biasing device is provided for the second guide member.

6. The sheet guide device according to claim 4 wherein a bias force by the first biasing device is greater than contact resistance between the sheet and the sheet conveying path.

7. The sheet guide device according to claim 6, wherein the bias force by the first biasing device is not applied to the sheet when the sheet is conveyed.

8. The sheet guide device according to claim 5, wherein the bias force of the second biasing device is substantially the same as the bias force of the third biasing device.

9. The sheet guide device according to claim 4, wherein the first and second guide members are provided in a curved sheet reversing path.

10. A sheet guide device to guide a sheet being conveyed in a sheet conveying path of the device, comprising:

a device configured to adjust widthwise sheet positioning by regulating side edges of the sheet, wherein the adjusting device is provided in a curved part of the sheet conveying path;

wherein said sheet conveying path is configured to convey and reverse a sheet, the sheet conveying path including a curved sheet conveying part and a stack part configured to guide and temporarily stack a portion of the sheet downstream of the curved sheet conveying part;

a first conveying guide to guide the sheet to the curved sheet conveying part;

a first conveying device to convey the sheet to the curved sheet conveying part;

a sheet position adjusting device provided in the curved sheet conveying part and configured to adjust the sheet position;

a reverse conveying device provided downstream of the first conveying device in the curved sheet conveying part to convey the sheet in the curved sheet conveying part in a reverse direction; and a second conveying guide to guide the sheet temporarily stacked in the stack path to be conveyed in the reverse direction;

wherein the curved sheet conveying part serves as a reverse path to reverse the sheet and the first conveying device is provided at an intersection of the first conveying guide and the second conveying guide.

11. The sheet guide device according to claim 10, wherein the reverse conveying device has a shape different from a round shape in a cross section.

12. The sheet guide device according to claim 10, wherein a second conveying device is provided downstream of the reverse conveying device in the second conveying guide to relay the sheet to be conveyed.

13. The sheet guide device according to claim 11, wherein a distance between a fall point in which a trailing edge of the sheet falls after passing through the first conveying device and a nip portion of the second conveying device is set smaller than a distance the sheet is conveyed by two rotations of the reverse conveying device.

14. The sheet guide device according to claim 12, wherein the second conveying device temporarily holds the sheet so as to place the sheet in a standby condition.

15. A sheet guide device to guide a sheet being conveyed in a conveying path of the device, comprising:

a device configured to adjust widthwise sheet positioning by regulating side edges of the sheet, wherein the adjusting device is provided in a curved part of the sheet conveying path;

wherein said sheet conveying path is configured to convey and reverse a sheet, the sheet conveying path including a curved sheet conveying part and a stack part configured to guide and temporarily stack a portion of the sheet downstream of the curved sheet conveying part;

a first conveying guide to guide the sheet to the curved sheet conveying part;

a first conveying device to convey the sheet to the curved sheet conveying part;

a sheet position adjusting device provided in the curved sheet conveying part and configured to adjust the sheet position;

a reverse conveying device provided downstream of the first conveying device in the curved sheet conveying part to convey the sheet in the curved sheet conveying part in a reverse direction; and a second conveying guide to guide the sheet temporarily stacked in the stack path to be conveyed in the reverse direction;

wherein at least one guide conveying member to guide and convey the sheet is provided on a shaft for the first conveying device so as to be positioned in a vicinity of a side edge of the sheet.

16. The sheet guide device according to claim 15, wherein a circumferential surface of the guide conveying member is made uneven.

17. An image forming apparatus comprising:

a sheet guide device to guide a sheet being conveyed in a sheet conveying path of the device, the sheet guide device including a device to adjust widthwise sheet positioning by regulating side edges of the sheet, wherein the adjusting device is provided in a curved part of the sheet conveying path;

said sheet guide device including:

a first guide member provided in the sheet conveying path to adjust a sheet position by regulating a side edge of the sheet, the first guide member being movable widthwise according to a sheet size;

a first biasing device to absorb a difference in size of the sheet due to a cutting error of the sheet when the sheet position is adjusted; and a second biasing device to bias the side edge of the sheet in accordance with a variance in the size of the sheet when the sheet is conveyed;

wherein the first biasing device and the second biasing device are provided for the first guide member.

18. An image forming apparatus comprising:

a sheet guide device to guide a sheet being conveyed in a sheet conveying path of the device, said sheet guide device including:

a sheet conveying path to convey and reverse a sheet, said sheet conveying path including a curved sheet conveying part and a stack part configured to guide and temporarily stack a portion of the sheet downstream of the curved sheet conveying part;

a first conveying guide to guide the sheet to the curved sheet conveying part;

a first conveying device to convey the sheet to the curved sheet conveying part;

a sheet position adjusting device provided in the curved sheet conveying part and configured to adjust a sheet position;

a reverse conveying device provided downstream of the first conveying device in the curved sheet conveying part to convey the sheet in the curved sheet conveying part in a reverse direction; and a second conveying guide to guide the sheet temporarily stacked in the stack path to be conveyed in the reverse direction.

19. An image forming apparatus comprising:

a sheet guide device to guide a sheet being conveyed in a sheet conveying path of the device, said sheet guide device including:

a device configured to adjust widthwise sheet positioning by regulating side edges of the sheet, wherein the adjusting device is provided in a curved part of the sheet conveying path; and a sheet conveying roller to convey the sheet, wherein the adjusting device is positioned on a shaft of the sheet conveying roller and is slidable along the shaft.

* * * * *

UNITED STATES PATENT AND TRADEMARK OFFICE

CERTIFICATE OF CORRECTION

PATENT NO. : 6,279,900 B1
DATED : August 28, 2001
INVENTOR(S) : Yamagishi

It is certified that error appears in the above-identified patent and that said Letters Patent is hereby corrected as shown below:

Title page,
Item [30], the Foreign Application Priority information should read, -- [30] Foreign Application Priority Data

Mar. 23, 1998 (JP) ..... 10-094046
Jul. 15, 1998 (JP) ..... 10-199978
Sep. 8, 1998 (JP) ..... 10-253739
Jan. 28, 1999 (JP) ..... 11-019605 --

Signed and Sealed this

Fourteenth Day of May, 2002

*Attest:*

*Attesting Officer*

JAMES E. ROGAN
*Director of the United States Patent and Trademark Office*